US006614183B2

(12) United States Patent
Masuda et al.

(10) Patent No.: US 6,614,183 B2
(45) Date of Patent: Sep. 2, 2003

(54) PLASMA DISPLAY PANEL AND METHOD OF MANUFACTURING THE SAME

(75) Inventors: Kohsuke Masuda, Yamanashi-ken (JP); Hitoshi Taniguchi, Yamanashi-ken (JP); Toshihiro Komaki, Yamanashi-ken (JP); Kimio Amemiya, Yamanashi-ken (JP); Sota Okamoto, Yamanashi-ken (JP); Shin Matsuda, Yamanashi-ken (JP); Hiroshi Adachihara, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 52 days.

(21) Appl. No.: 09/775,569

(22) Filed: Feb. 5, 2001

(65) Prior Publication Data

US 2001/0017520 A1 Aug. 30, 2001

(30) Foreign Application Priority Data

Feb. 29, 2000 (JP) ..... 2000-053834
Mar. 9, 2000 (JP) ..... 2000-065367

(51) Int. Cl.[7] ..... G09G 3/28; H01J 17/49
(52) U.S. Cl. ..... 313/586; 313/585; 313/587
(58) Field of Search ..... 313/586, 587, 313/584, 582, 583, 585, 472

(56) References Cited

U.S. PATENT DOCUMENTS 5,952,782 A * 9/1999 Nanto et al. ..... 313/584
6,344,715 B2 * 2/2002 Tokunaga et al. ..... 313/582
6,465,956 B1 * 10/2002 Koshio et al. ..... 313/586

* cited by examiner

*Primary Examiner*—Sandra O'Shea
*Assistant Examiner*—Bao Truong
(74) *Attorney, Agent, or Firm*—Arent Fox Kintner Plotkin & Kahn

(57) ABSTRACT

A plasma display panel includes a plurality of row electrode pairs (X, Y) forming display lines which are formed on a front glass substrate (10). Each row electrode (X, Y) of the row electrode pair (X, Y) makes up transparent electrodes (Xa, Ya) each formed opposing the corresponding transparent electrode (Xa, Ya) via a discharge gap (g) for each pair, and a bus electrode (Xb, Yb) connected to the transparent electrodes (Xa, Ya). In such plasma display panel, a light-shield layer 20A is formed at least on a portion between the two bus electrodes situated back to back and a required portion in proximal to sides of the bus electrodes (Xb, Yb) connected to the transparent electrodes (Xa, Ya) on the front glass substrate (10).

10 Claims, 19 Drawing Sheets

V 1 – V 1

V 1 − V 1

V 2 − V 2

W1 – W1

W2 – W2

V 1 – V 1

V 2 – V 2

V3—V3

V4—V4

W3—W3

W4—W4

V5—V5

V6—V6

W5—W5

W6—W6

V7–V7

V8–V8

W7—W7

W8—W8

V−V

W−W

PLASMA DISPLAY PANEL AND METHOD OF MANUFACTURING THE SAME

BACKGROUND OF THE INVENTION

1. Field of the Invention

The invention relates to a structure of a surface discharge scheme AC type plasma display panel, and a method of manufacturing the same.

2. Description of the Related Art

Recent years, a plasma display panel of a surface discharge scheme AC type as an oversize and slim display for color screen has been received attention, which is becoming widely available.

FIG. 27 is a schematically front view illustrating a cell structure of a conventional surface discharge scheme AC type plasma display panel. FIG. 28 is a sectional view taken along the V—V line of FIG. 27. FIG. 29 is a sectional view taken along the W—W line of FIG. 27.

In FIGS. 27 to 29, on the backside of a front glass substrate 1 to serve as a display surface of the plasma display panel, there is sequentially provided with a plurality of row electrode pairs (X', Y'); a dielectric layer 2 overlaying the row electrode pairs (X', Y'); and a protective layer 3 made of MgO which overlays a backside of the dielectric layer 2.

The row electrodes X' and Y' are respectively comprised of wider transparent electrodes Xa' and Ya' each of which is formed of a transparent conductive film made of ITO (Indium Tin Oxide) or the like, and narrower bus electrodes Xb' and Yb' each of which is formed of a metal film complementary to conductivity of the transparent electrode.

The row electrodes X' and Y' are arranged opposing each other with a discharge gap g' in between, and alternate in the column direction such that each row electrode pair (X', Y') forms a display line (row) L on a matrix display.

A back glass substrate 4 faces the front glass substrate 1 with a discharge space S', filled with a discharge gas, in between. The back glass substrate 4 is provided with a plurality of column electrodes D' arranged to extend in a direction perpendicular to the row electrode pairs X' and Y'; band-shaped partition walls 5 each extending between the adjacent column electrodes D' in parallel; and a phosphor layer 6 consisting of a red phosphor layer 6(R), green phosphor layer 6(G) and blue phosphor layer 6(B) which respectively overlay side faces of the partition walls 5 and the column electrodes D'.

In each display line L, the partition wall 5 defines discharge cells C', each forming a unit light emitting area, at respective areas of the discharge space S' in which the column electrode D' and the row electrode pair (X', Y') intersect.

In the above surface discharge scheme AC type plasma display panel, an image is displayed as follows:

First, through addressing operation, opposite discharge is caused selectively between the row electrode pairs (X', Y') and the column electrodes D' in the respective discharge cells C', to scatter lighted cells (the discharge cell in which wall charge is formed on the dielectric layer 2) and non-lighted cells (the discharge cell in which wall charge is not formed on the dielectric layer 2), over the panel in accordance with the image to be displayed.

After the addressing operation, in all the display lines L, discharge sustain pulses are applied alternately to the row electrode pairs (X', Y') in unison, and thus surface discharge is produced in the lighted cells on every application of the discharge sustain pulse.

In this manner, the surface discharge in each lighted cell generates ultraviolet radiation, and thus the red phosphor layer 6(R) and/or the green phosphor layer 6(G) and/or the blue phosphor layer 6(B) each formed in the discharge cell C' are excited to emit light, resulting in forming the display image.

Such a conventional surface discharge scheme AC type plasma display panel has a disadvantage in which contrast on a screen formed on the plasma display panel is decreased, because of that, in each area between the back-to-back bus electrodes Xb' and Yb' serving as a non-display line, incoming ambient light is reflected off by the phosphor layer 6 formed on the back glass substrate 4.

Hence, the applicant of the present invention has suggested an alternative plasma display panel capable of improving contrast. The improvement of contrast is accomplished by forming a black or dark-brown band-shaped light-shield layer 7 extending along the row direction between bus electrodes Xb' and Yb' arranged back to back on a dielectric layer 2 so as to prevent the reflection of ambient light from the non-display lines.

However, the light-shield layer 7 formed by a printing technique has a disadvantage on the pattern precision and has not yet completely prevented the reflection of the ambient light.

Therefore, the further improvement of contrast has been desired.

SUMMARY OF THE INVENTION

The present invention has been made to solve such a conventional disadvantage in the surface discharge scheme AC type plasma display panel.

It is therefore a first object of the present invention to provide a plasma display panel which is capable of further improving contrast on a screen formed on the plasma display panel to display high quality images.

Further, it is a second object of the present invention to provide a method of manufacturing a plasma display panel capable of further improving contrast on a screen formed on the plasma display panel to display high quality images.

To attain the above first object, a plasma display panel according to a first invention includes a plurality of row electrode pairs extending in a row direction and arranged in a column direction to form display lines on a backside of a front substrate, and a plurality of column electrodes extending in the column direction and arranged in the row direction to constitute unit light emitting areas at respective positions corresponding to the intersections of the column electrodes and the row electrode pairs in a discharge space on a surface of a back substrate facing the front substrate with a discharge space in between, in which each row electrode of the row electrode pair is made up of transparent electrodes, each formed opposite to the corresponding transparent electrode via a predetermined discharge gap, and a bus electrode which extends in the row direction and is connected ends of the transparent electrodes situated opposite to the discharge gap. Such plasma display panel features in that a light-shield layer is formed at least on a portion between the two back-to-back bus electrodes of the adjacent row electrode pairs in the row direction and on required portions in proximity to the sides of the bus electrodes each connected to the transparent electrode, on the backside of the front substrate.

The plasma display panel according to the first invention is designed to form the display images by means of the opposing discharge selectively caused between the transparent electrode of each row electrode and the corresponding column electrode and the surface discharge caused between the transparent electrodes through the discharge gap in each row electrode pair. The light-shield layer which is black, dark brown or the like in color absorbing light overlays each portion between the two back-to-back bus electrodes which serves as a non-display line during the formation of images, and each required portion of the proximal ends of the transparent electrodes. At these proximal ends, the discharge light emission is low due to the increased distance from the discharge gap in which the surface discharge is caused.

In consequence, according to the first invention, the light-shield layer absorbs ambient light incident from the display surface of the front substrate directed toward the non-display area for images not to permit the reflection of ambient light. This improves the contrast on the screen. Further, the light-shield layer is also formed on the required portion in proximity to the connection of the bus electrode to the transparent electrodes so as to overlay the portions not much contributing to the light emission for forming images. For this reason, it is possible to sufficiently prevent the reflection of ambient light in the non-displaying image area even when the precision of formation of the light-shield layer is not high, and this further improves the contrast on the screen.

To attain the aforementioned first object, the plasma display panel according to a second invention features, in addition to the configuration of the first invention, in that a partition wall is arranged between the front substrate and the back substrate and includes vertical walls extending in the column direction and transverse walls extending in the row direction to define the discharge space into the unit light emitting areas in the row direction and the column direction, and in that the light-shield layer is formed at a position corresponding to a face of the transverse wall of the partition wall on the front substrate side when viewed from the front substrate.

According to the plasma display panel of the second invention, the light-shield layer overlays the portions of the display surface of the front substrate which serve as the non-display image area because the portions oppose the transverse walls of the partition wall defining the discharge space into the unit light emitting areas. Therefore, it is possible to improve the contrast on the screen even when the discharge space is defined by the partition wall having the transverse walls.

To attain the aforementioned first object, the plasma display panel according to a third invention features, in addition to the configuration of the first invention, in that a portion of the bus electrode on the front substrate side consists of a light absorption layer.

According to the plasma display panel of the third invention, there are the light absorption layer forming the portion of each bus electrode on the front substrate side and the light-shield layer formed on each portion between the two back-to-back bus electrodes and each required portion in proximity to the connections of the bus electrodes to the transparent electrodes. These two layers overlay most of portions serving as the non-display image area on the display surface of the front substrate to prevent the reflection of ambient light from such portions, resulting in improvement in contrast on the screen.

To attain the aforementioned first object, the plasma display panel according to a fourth invention features, in addition to the configuration of the first invention, in that the light-shield layer is formed on a portion of the backside of the front substrate opposing the vertical wall of the partition wall.

According to the plasma display panel of the fourth invention, the light-shield layer overlays the portions on the display surface of the front substrate which serve as the non-display image area because they oppose the transverse walls of the partition wall defining the discharge space into the unit light emitting areas. Therefore, it is possible to improve the contrast on the screen even when the discharge space is defined by the partition wall having the vertical walls.

To attain the aforementioned first object, the plasma display panel according to a fifth invention includes a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction to constitute unit light emitting areas in a discharge space at respective positions, corresponding to intersections of the column electrodes and the row electrode pairs, on a surface of a back substrate facing the front substrate with a discharge space in between, each row electrode of the row electrode pair being made up of transparent electrodes each formed to oppose the corresponding transparent electrode via a predetermined discharge gap, and a bus electrode extending in the row direction and connected an end of the transparent electrode situated opposite to the discharge gap. Such plasma display panel features in that a light-shield layer is formed on the dielectric layer to overlay a portion situated between the row electrode pairs and surrounded by the respective bus electrodes when viewed from the front substrate.

The plasma display panel according to the fifth invention is designed to form the display images by means of the opposing discharge selectively caused between the transparent electrode of each row electrode and the corresponding column electrode and the surface discharge caused between the transparent electrodes through the discharge gap in each row electrode pair. The light-shield layer being black, dark brown or the like in color absorbing light overlays each portion of the dielectric layer opposing the portion between the two back-to-back bus electrodes which serves as a non-display line during the formation of images.

Hence, according to the fifth invention, the light-shield layer absorbs ambient light incident from the display surface of the front substrate directed toward the non-display image area not to permit the reflection of ambient light. This improves the contrast on the screen. Further, since the light-shield layer is also formed on the dielectric layer, the precision of the patterning can be increased when the light-shield layer is formed. This further improves the contrast on the screen.

To attain the aforementioned first object, the plasma display panel according to a sixth invention features, in addition to the configuration of the fifth invention, in that a partition wall is arranged between the front substrate and the back substrate and includes vertical walls extending in the column direction and transverse walls extending in the row direction to define the discharge space into the unit light emitting areas in the row direction and the column direction, and in that the light-shield layer is formed on the dielectric layer in alignment with the vertical wall of the partition wall when viewed from the front substrate.

According to the plasma display panel of the sixth invention, although the vertical walls serves as non-display lines in the case where the partition wall including the vertical walls and the transverse walls defines the discharge space into the pattern in which parallel lines cross at right angles, the reflection of ambient light incident upon the vertical walls is prevented by the light-shield layer formed on the portion of the dielectric layer opposing the vertical wall. This further improves the contrast on the screen.

To attain the aforementioned first object, the plasma display panel according to a seventh invention features includes a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction to constitute unit light emitting areas in a discharge space at respective positions, corresponding to intersections of the column electrodes and the row electrode pairs, on a surface of a back substrate facing the front substrate with a discharge space in between, each row electrode of the row electrode pair being made up of transparent electrodes each formed to oppose the corresponding transparent electrode via a predetermined discharge gap, and a bus electrode extending in the row direction and connected an end of the transparent electrode situated opposite to the discharge gap. Such plasma display panel features in that an additional portion is formed on a backside of the dielectric layer to oppose the back-to-back arranged bus electrodes of the adjacent row electrode pairs in the column direction and a portion surrounded by the back-to-back bus electrodes and to protrude toward the discharge space, and in that a light-shield layer is formed on at least a portion of the additional portion opposing the portion surrounded by the back-to-back bus electrodes.

The plasma display panel according to the seventh invention is designed to form the display images by means of the opposing discharge selectively caused between the transparent electrode of each row electrode and the corresponding column electrode and the surface discharge caused between the transparent electrodes through the discharge gap in each row electrode pair. The light-shield layer being black, dark brown or the like in color absorbing light overlays each portion of the additional portion opposing the area between the two back-to-back bus electrodes which serves as a non-display line during the formation of images.

Hence, according to the seventh invention, the light-shield layer configured in the additional portion absorbs ambient light incident from the display surface of the front substrate directed toward the non-display image area not to permit the reflection of ambient light. This improves the contrast on the screen. Further, since the light-shield layer is also formed on the additional portion, the precision of patterning can be increased when the light-shield layer is formed. This further improves the contrast on the screen.

To attain the aforementioned first object, the plasma display panel according to an eighth invention features, in addition to the configuration of the seventh invention, in that the additional portion is formed of a black or dark color photosensitive resin.

According to the plasma display panel of the eighth invention, the entire additional portion serves as a light-shield layer. This can almost completely prevent the reflection of ambient light incident upon the non-display area between the bus electrodes so as to improve the contrast.

To attain the aforementioned first object, the plasma display panel according to a ninth invention features, in addition to the configuration of the seventh invention, in that a joint face of the additional portion to the dielectric layer consists of the light-shield layer.

According to the plasma display panel of the ninth invention, the light-shield layer formed on the joint face of the additional portion to the dielectric layer prevents the reflection of the ambient light incident upon the non-display line area between the bus electrodes, resulting in the improvement in contrast.

To attain the aforementioned first object, the plasma display panel according to a tenth invention features, in addition to the configuration of the seventh invention, in that a partition wall is arranged between the front substrate and the back substrate and includes vertical walls extending in the column direction and transverse walls extending in the row direction to define the discharge space into the unit light emitting areas in the row direction and the column direction, and in that the light-shield layer forms a face of the partition wall on the front substrate side.

According to the plasma display panel of the tenth invention, although the portions of the vertical walls of the partition wall serves as the non-display image area in the case where the partition wall including the vertical walls defines the discharge space into the unit light emitting areas, since the light-shield layer forms the face of the vertical wall on the display surface side, the reflection of the ambient light incident upon the non-display image area is prevented, resulting in the further improvement in contrast on the screen.

To attain the aforementioned second object, a method of manufacturing a plasma display panel according to an eleventh invention features the steps of a lamination process for laminating a film including a black or dark color photosensitive resin layer on a front substrate on which row electrodes each including transparent electrodes and a bus electrode are formed in pair to extend in a row direction and be arranged in a column direction, with the photosensitive resin layer facing the front substrate to overlay the row electrode pairs; and a removal process for removing the photosensitive resin layer except for the portions corresponding to at least a portion between the bus electrodes of the two row electrodes situated back to back and a required portion in proximity to the connection of the bus electrode with the transparent electrodes, after the lamination process.

According to the method of manufacturing the plasma display panel of the eleventh invention, after the film including the black or dark color photosensitive resin layer is laminated on approximately the front of the front substrate on which the row electrode pairs are formed, a light-shield layer is formed to overlay the portions serving as the non-display image area by the technique for removing the photosensitive resin layer except for the portion corresponding to the non-display image area. Therefore, the light-shield layer can be formed with high precision.

To attain the aforementioned second object, the method of manufacturing the plasma display panel according to a twelfth invention features, in addition to the configuration of the eleventh invention, in that the film consists of two layers of the black or dark color photosensitive resin layer and a non-photosensitive resin layer, and has a thickness larger than that of the transparent electrode of the row electrode, and the photosensitive resin layer has a thickness equal to or smaller than that of the transparent electrode.

When the film is laminated on the front substrate on which the dumps are formed due to the bus electrodes and the like, if a thickness of the film is equal to or smaller than that of the dump, a problem in which air is caught up in the dump area occurs.

According to the method of manufacturing the plasma display panel of the twelfth invention, however, while a film thickness of the photosensitive resin layer is set to be smaller than that of the bus electrode, the non-photosensitive resin layer functioning as a dummy layer can increase the total film thickness of the film so as to allow it to sufficiently exceed the film thickness of the bus electrode. For this reason, catching up air in the dump area is prevented.

To attain the aforementioned second object, the method of manufacturing the plasma display panel according to a thirteenth invention features, in addition to the configuration of the eleventh invention, in that the photosensitive resin layer is removed by the patterning using an exposure mask in the removing process.

According to the method of manufacturing the plasma display panel of the thirteenth invention, in order to form the light-shield layer, the patterning in which the film laminated on the front substrate is exposed to light through the exposure mask for developing is performed on the photosensitive resin layer to remove the portions corresponding to the display image area on the front substrate. Hence, the light-shield layer can be easily and precisely formed.

To attain the aforementioned second object, a method of manufacturing a plasma display panel according to a fourteenth invention features in including a light-shield layer forming process for forming a light-shield layer on a portion of a dielectric layer opposing a portion situated between row electrode pairs and surrounded by bus electrodes, which is performed after the row electrodes each including transparent electrodes and the bus electrode are formed in pair on a front substrate to extend in a row direction and be arranged in a column direction, and then a dielectric layer is formed to overlay the row electrode pairs.

According to the method of manufacturing the plasma display panel of the fourteenth invention, the light-shield layer being black, dark-brown or the like in color absorbing light overlays the portion on the dielectric layer opposing the portion between the two back-to-back bus electrodes which will serve as the non-display line when images are formed. This allows the light-shield layer to absorb ambient light incident from the display surface of the front substrate directed toward the non-display image area, to prevent the reflection of the ambient light, resulting in the improvement in contrast on the screen. Further since the light-shield layer is formed on the dielectric layer, it is possible to increase the precision of the patterning upon formation and to further improve the contrast on the screen.

To attain the aforementioned second object, the method of manufacturing the plasma display panel according to a fifteenth invention features, in addition to the configuration of the fourteenth invention, in that the light-shield layer forming process comprises a lamination process for laminating a film including a black or dark color photosensitive resin layer on the dielectric layer, and a removal process for removing the film except for at least the portion corresponding to the portion surrounded by the bus electrodes and situated between the row electrode pairs, after the lamination process.

According to the method of manufacturing the plasma display panel of the fifteenth invention, the dielectric layer is formed on the front substrate on which the row electrode pairs have been formed, to overlay the row electrode pairs, and then the film including the black or dark-color photosensitive resin layer is laminated on the dielectric layer. After that, the light-shield layer to overlay the non-display image area is formed by a technique for removing the photosensitive resin layer except for portions corresponding to the non-display image area. Thus, the light-shield layer can be precisely formed.

To attain the aforementioned second object, a method of manufacturing a plasma display panel according to a sixteenth invention features an additional-dielectric layer forming process for forming an additional dielectric layer having a light-shield layer on a portion on a dielectric layer opposing two back-to-back arranged bus electrodes of adjacent row electrode pairs in a column direction and a portion surrounded by the two back-to-back bus electrodes, which is performed after the row electrodes each including transparent electrodes and the bus electrode are formed in pair on a front substrate to extend in a row direction and be arranged in a column direction, and then a dielectric layer is formed to overlay the row electrode pairs.

According to the method of manufacturing the plasma display panel of the sixteenth invention, the light-shield layer which is black, dark-brown or the like in color absorbing light forms at least the portion of the additional portion opposing each area between the two back-to-back bus electrodes which will serves as the non-display line at the time of formation of images. For this reason, the light-shield layer absorbs ambient light incident from the display surface of the front substrate directed toward the non-display image area not to permit the reflection of the ambient light, resulting in improvement in contrast on the screen. Further, the formation of the light-shield layer on the additional portion enhances the precision of the patterning upon formation of the light-shield layer, resulting in further improvement in contrast on the screen.

To attain the aforementioned second object, the method of manufacturing the plasma display panel according to a seventeenth invention features, in addition to the configuration of the sixteenth invention, in that the additional-dielectric layer forming process comprises a lamination process for laminating a film including a black or dark color photosensitive resin layer on the dielectric layer, and a removal process for removing the film except for the portion corresponding to the two back-to-back arranged bus electrodes of the adjacent row electrode pairs in column direction and the portion surrounded by the two back-to-back bus electrodes, after the lamination process.

According to the method of manufacturing the plasma display panel of the seventeenth invention, the dielectric layer is formed on the front substrate on which the row electrode pairs having been formed, to overlay the row electrode pairs. Then the film including the black or dark-color photosensitive resin layer is laminated on the dielectric layer. After that, the additional portion is formed by a technique for removing the film except for the portions corresponding to the additional portion. Thus, the additional portion configured by the light-shield layer can be smoothly formed.

To attain the aforementioned second object, the method of manufacturing the plasma display panel according to an eighteenth invention features, in addition to the configuration of the sixteenth invention, in that the additional-dielectric layer forming process comprises a lamination process for laminating a multi-layer film, including a black or dark color photosensitive resin layer and a transparent photosensitive resin layer, on the dielectric layer with the black or dark color photosensitive resin layer facing the dielectric layer, and a removal process for removing the film except for the portion corresponding to the two back-to-back bus electrodes of the adjacent row electrode pairs in the column direction and the portion surrounded by the two back-to-back bus electrodes, after the lamination process.

According to the method of manufacturing the plasma display panel of the eighteenth invention, the dielectric layer is formed on the front substrate on which the row electrode pairs having been formed, to overlay the row electrode pairs. Then the multi-layer film including the black or dark-color photosensitive resin layer and the transparent photosensitive resin layer is laminated on the dielectric layer. After that, the additional portion is formed by a technique for removing the film except for the portion corresponding to the additional portion. Thus, the additional portion including the light-shield layer can be smoothly formed. Moreover, when the additional portion is formed by the pattering in the photolithographic process in which the film is exposed to light through the exposure mask for developing, the transparent photosensitive resin layer of the film is set as the exposure face. This allows decrease of photosensitive characteristics during the exposing to be suppressed.

These and other objects and advantages of the present invention will become obvious to those skilled in the art upon review of the following description, the accompanying drawings and appended claims.

DETAILED DESCRIPTION OF THE PREFERRED EMBODIMENT

Most preferred embodiment according to the present invention will be described hereinafter in detail with reference to the accompanying drawings.

Figure 1:
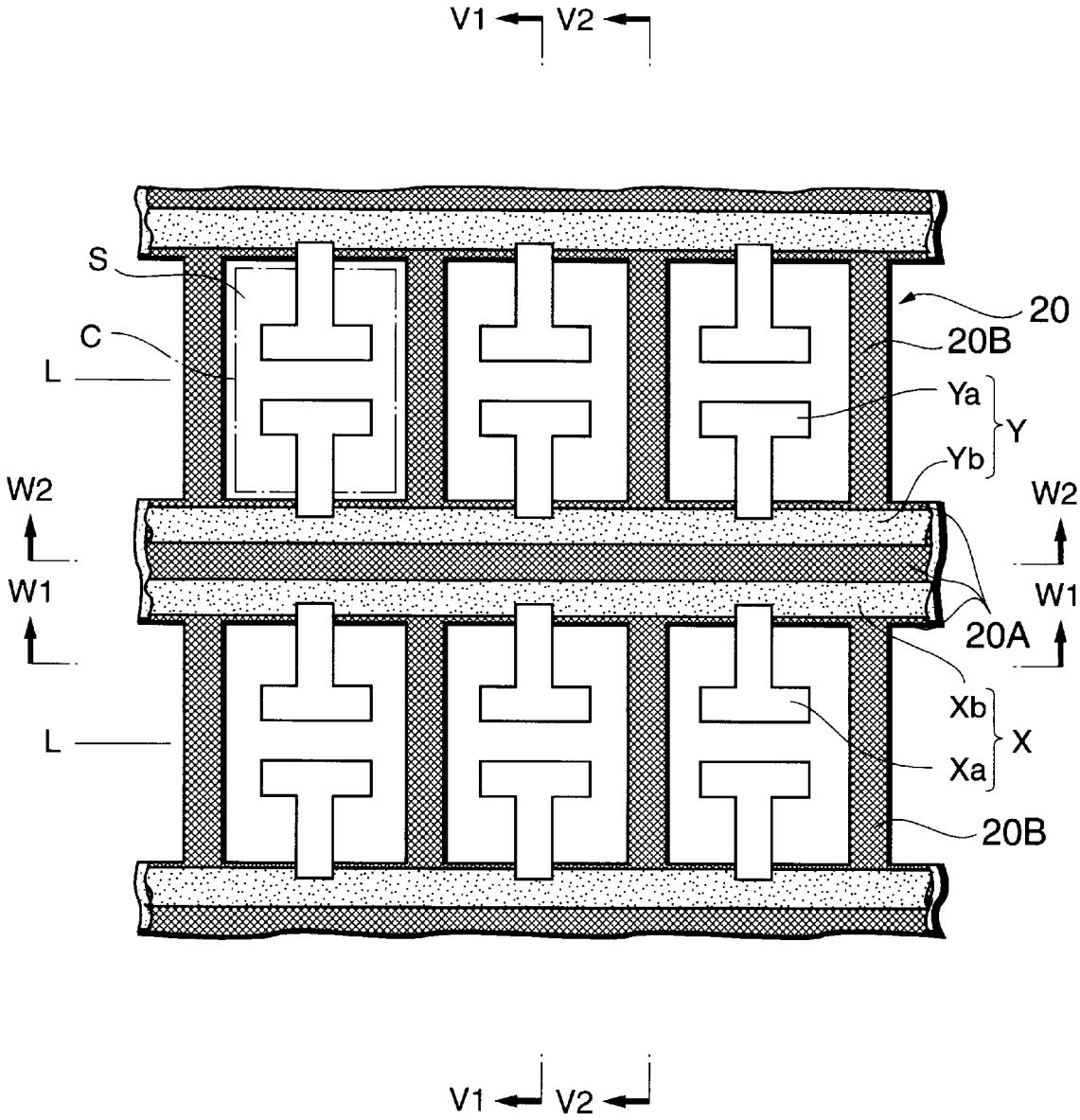
FIG. 1 is a front view schematically showing a first example according to the present invention.
Figure 2:
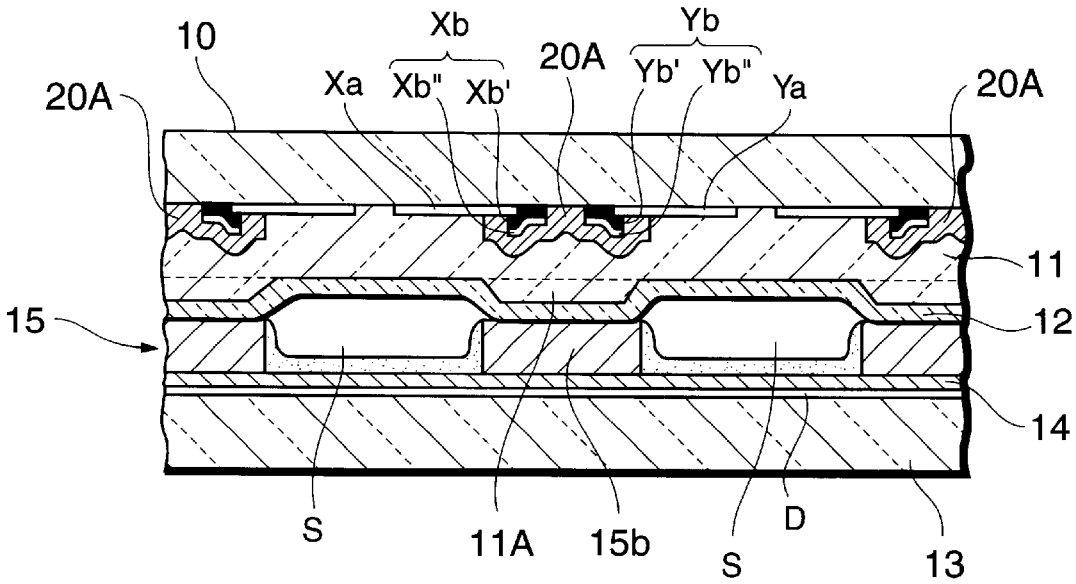
FIG. 2 is a sectional view taken along the V1—V1 line of FIG. 1.
Figure 3:
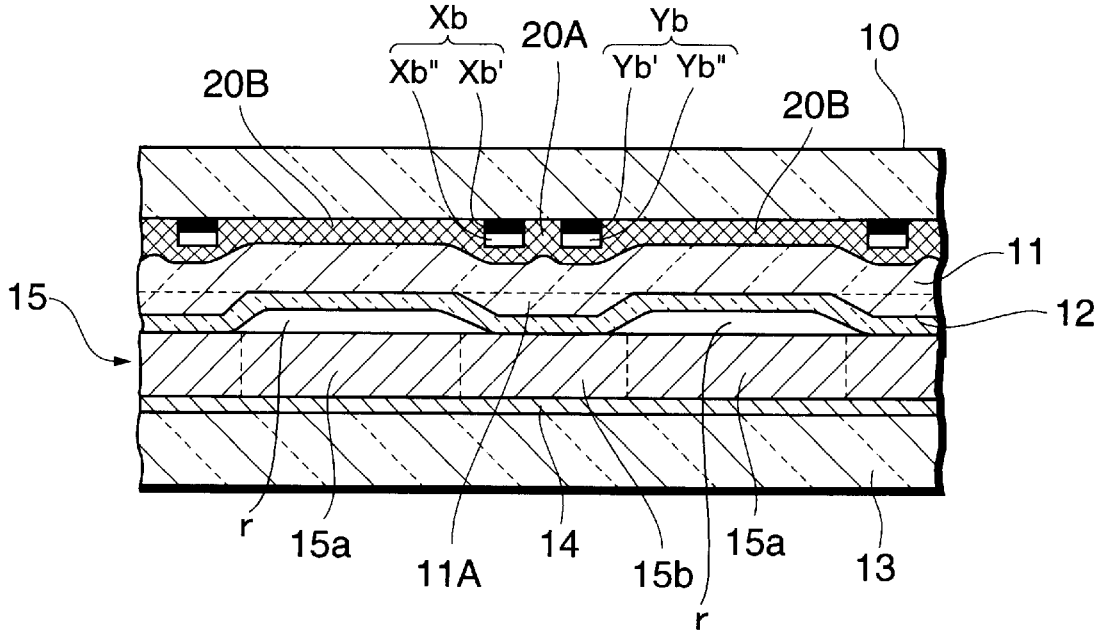
FIG. 3 is a sectional view taken along the V2—V2 line of FIG. 1.
Figure 4:
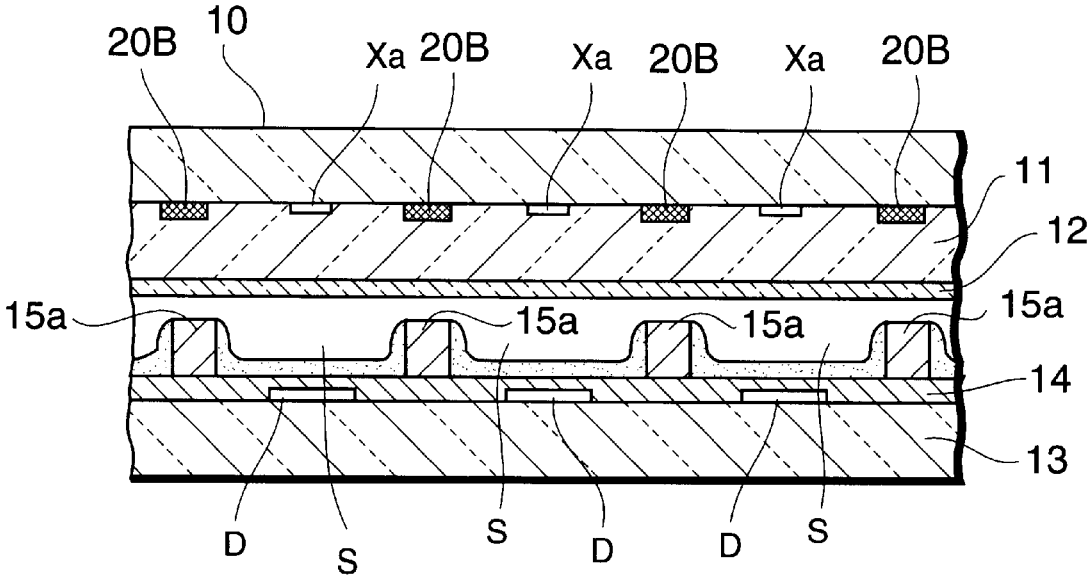
FIG. 4 is a sectional view taken along the W1—W1 line of FIG. 1.
Figure 5:
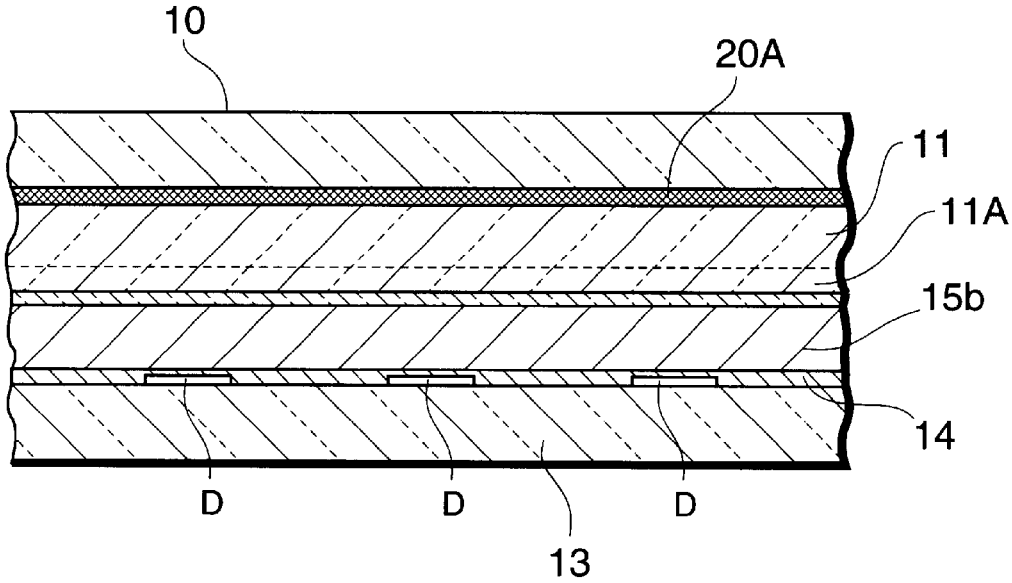
FIG. 5 is a sectional view taken along the W2—W2 line of FIG. 1.

FIGS. 1 to 5 illustrate a first example of the embodiment of a plasma display panel (referred as "PDP" hereinafter) according to the present invention. FIG. 1 is a front view schematically illustrating a configuration of the PDP. FIG. 2 is a sectional view taken along the V1—V1 line of FIG. 1. FIG. 3 is a sectional view taken along the V2—V2 line of FIG. 1. FIG. 4 is a sectional view taken along the W1—W1 line of FIG. 1. FIG. 5 is a sectional view taken along the W2—W2 line of FIG. 1.

In FIG. 1 to FIG. 5, on a backside of a front glass substrate 10 serving as a display surface, a plurality of row electrode pairs (X, Y) are arranged in parallel to extend in the row direction (the traverse direction in FIG. 1) of the front glass substrate 10.

A row electrode X is composed of transparent electrodes Xa formed in a T-like shape of a transparent conductive film made of ITO or the like, and a bus electrode Xb which is formed of a metal film extending in the row direction of the front glass substrate 10 to connect to a proximal end of the narrowed portion of the transparent electrode Xa.

Likewise, a row electrode Y is composed of a transparent electrode Ya which is formed in a T-like shape of a transparent conductive film made of ITO or the like, and a bus electrode Yb which is formed of a metal film extending in the row direction of the front glass substrate 10 to connect to a proximal end of the narrowed portion of the transparent electrode Ya.

The row electrodes X and Y are alternated in the column direction (in the vertical direction in FIG. 1) of the front glass substrate 10. The transparent electrodes Xa and Ya arranged along the respective bus electrodes Xb and Yb, extend mutually toward a mate of the paired row electrodes such that the top sides (or the distal ends) of the wide portions of the transparent electrodes Xa and Ya face each other with a discharge gap g having a predetermined width in between.

Each of the bus electrodes Xb and Yb is formed in a double-layer structure with a black conductive layer Xb' or Yb' on the display surface side and a main conductive layer Xb" or Yb" on the back surface side.

On the backside of the front glass substrate 10, a dielectric layer 11 is further formed to overlay the row electrode pairs (X, Y). Furthermore, on the backside of the dielectric layer 11, an additional dielectric layer 11A is formed at each position opposing the adjacent bus electrodes Xb and Yb of the respective row electrode pairs (X, Y) adjacent to each other, and opposing each area between the adjacent bus electrodes Xb and Yb. The additional dielectric layer 11A is formed in such a manner to protrude from the backside of the dielectric layer 11 and to extend in parallel to the bus electrodes Xb, Yb.

On the backsides of the dielectric layer 11 and the additional dielectric layers 11A, a protective layer 12 made of MgO is formed.

Further, a back glass substrate 13 is arranged in parallel to the front glass substrate 10. On the front surface of the back glass substrate 13 on the display surface side, column electrodes D are disposed in parallel at regularly established intervals from one another. Each column electrode D is formed in such a manner to extend at positions opposing the transparent electrodes Xa and Ya of the respective pairs of the row electrodes (X, Y) in a direction orthogonal to the row electrode pair (X, Y) (the column direction).

A white dielectric layer 14 is further formed on the front surface of the back glass substrate 13 on the display surface side to overlay the column electrodes D, and a partition wall 15 is formed on the dielectric layer 14.

The partition wall 15 is formed in a chessboard-square like pattern by vertical walls 15*a* each extending in the column direction between the adjacent column electrodes D arranged in parallel to each other, and transverse walls 15*b* each extending in the row direction in a position opposing each additional dielectric layer 11A.

The transverse wall 15*b* of the partition wall 15 is formed to have a slightly larger width in the column direction than the sum of widths of the back-to-back bus electrodes Xb and Yb and a width of an area between these bus electrodes Xb and Yb.

The partition wall 15 in a chessboard-square-like pattern defines the discharge space S between the front glass substrate 10 and the back glass substrate 13 into areas each facing the paired transparent electrodes Xa and Ya of each row electrode pair (X, Y) so as to form quadrangular discharge cells C.

The face of each vertical wall 15*a* of the partition wall 15 on the display surface side is out of contact with the protective layer 12 (see FIG. 4) to form a clearance r there between, whereas the face of each transverse wall 15*b* on the display surface side is in contact with a portion of the protective layer 12 overlaying the additional dielectric layer 11A (see FIGS. 2, 3 and 5) to shield the adjacent discharge cells C from each other in the column direction.

On the five faces of a surface of the dielectric layer 14 and the side faces of the vertical walls 15*a* and the transverse walls 15*b* of the partition wall 15 facing each discharge cell C, a phosphor layer 16 is formed to overlay all of them. The phosphor layers 16 are set in order of red (R), green (G) and blue (B) for the sequence of discharge cells in the row direction.

The inside of the discharge cell C is filled with a discharge gas.

In addition to the above configuration of the PDP, the row electrode pairs (X, Y) are formed on the backside of the front glass substrate 10. After that, on a portion of the backside of the front glass substrate 10 opposing each transverse wall 15*b* of the partition wall 15, a black or dark-brown light-shield layer 20A extending in the row direction is formed to overlay the bus electrodes Xb and Yb arranged back to back, each area between the back-to-back bus electrodes Xb and Yb, and portions of the proximal ends of the transparent electrodes Xa and Ya respectively connected to these bus electrodes Xb and Yb.

Further, on a portion of the backside of the front glass substrate 10 opposing each vertical wall 15*a*, a black or dark-brown light-shield layer 20B is formed to extend in the column direction and to have its both ends continuing from the light-shield layer 20A.

The light-shield layers 20A and 20B make up a chessboard-square-like patterned light-shield layer 20.

After the light-shield layer 20 is formed, the dielectric layer 11 is formed.

In the above PDP, each row electrode pair (X, Y) makes up a display line (row) L on a matrix display screen. Each discharge space S divided by the chessboard-square-like patterned partition wall 15 establishes demarcation of each discharge cell C.

As in the conventional PDP, an image is displayed in the PDP.

Specifically, through addressing operation, discharge is produced selectively between the row electrode pair (X, Y) and the column electrode D in each discharge cell C, to scatter lighted cells (the discharge cells in which the wall charge on the dielectric layer 11 is not cancelled) and nonlighted cells (the discharge cells in which the wall charge on the dielectric layer 11 is cancelled), in all the display lines L over the panel in accordance with the image to be displayed.

After the addressing operation, in all the display lines L, the discharge sustain pulse is applied alternately to the row electrode pairs (X, Y) in unison. In each lighted cell, surface discharge is caused for every application of the sustaining discharge pulse.

In this manner, the surface discharge in each lighted cell generates ultraviolet radiation, and thus the red, green and blue phosphor layers 16 formed in the discharge space S are individually excited to emit light, resulting in forming an image to be displayed.

In the above-mentioned PDP, the light-shield layer 20A overlays the face of each transverse wall 15*b* of the partition wall 15 on which the phosphor is not formed. This allows the light-shield layer 20A to absorb ambient light, incident from the front glass substrate 10 directed toward the area between the bus electrodes Xb and Yb as a non-display line and toward the proximal end portions of the transparent electrodes Xa and Ya. At these proximal end portions the discharged light emission is low due to the increased distance from the gap g. As a result, the reflection of the ambient light incident upon such area and proximal end portion is prevented.

In the above PDP, further, the light-shield layer 20B similarly overlays the face of each vertical wall 15*a* of the partition wall 15 on which the phosphor is not formed, to absorb ambient light incident upon a portion of each vertical wall 15*a* as a non-display line, resulting in preventing the reflection of the ambient light incident upon such portion.

Figure 6:
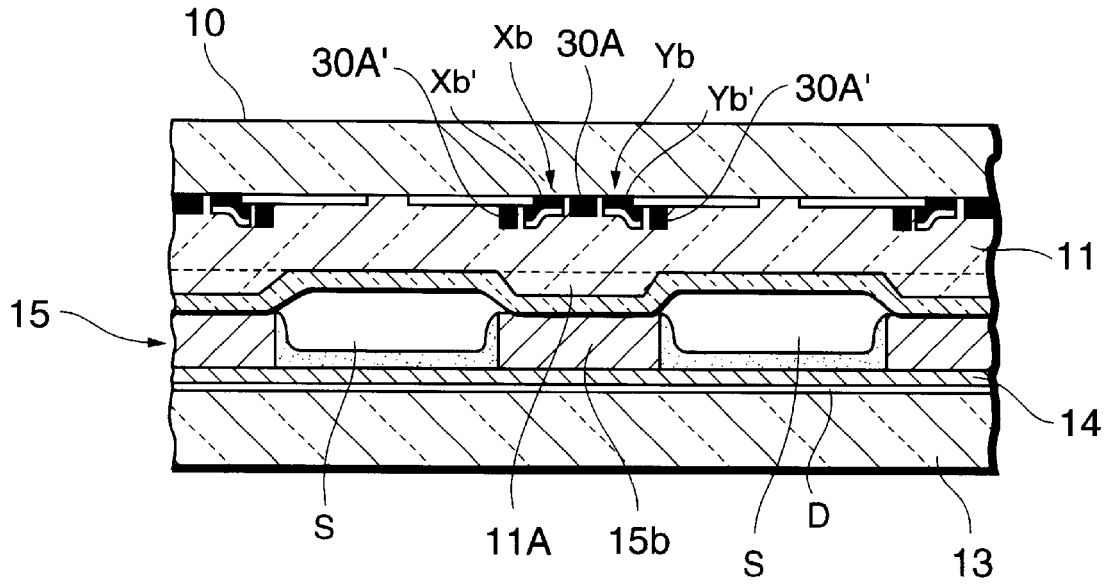
FIG. 6 is a side sectional view showing a second example according to the present invention.
Figure 7:
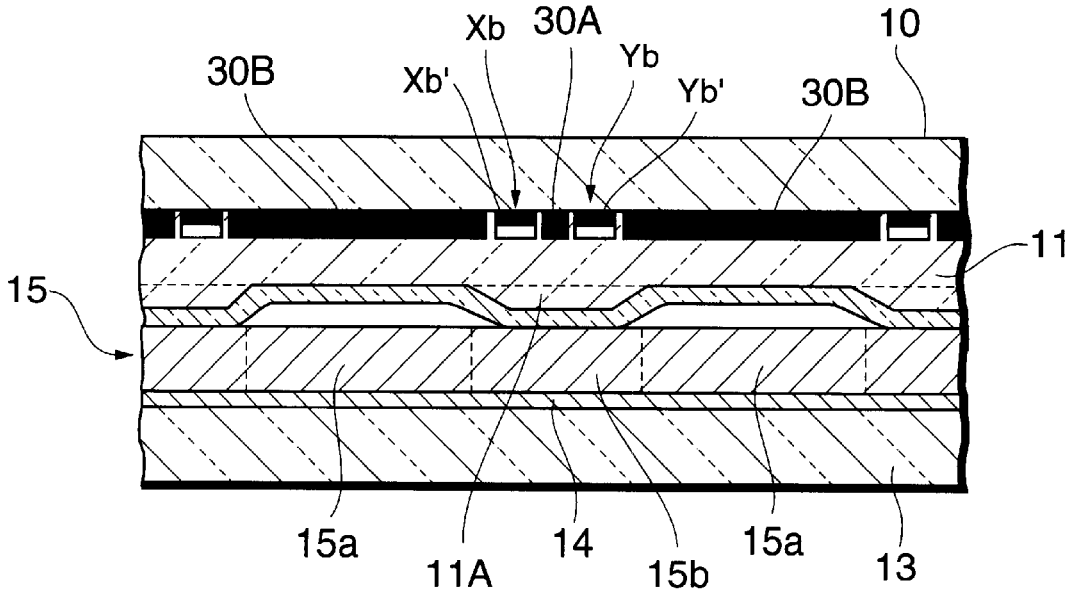
FIG. 7 is a side sectional view of another portion of the second example.

Next, FIGS. 6 and 7 illustrate a second example of the embodiment according to the present invention. FIG. 6 is a sectional view of the same portion of that in FIG. 2 of the first example, and FIG. 7 is a sectional view of the same portion of that in FIG. 3 of the first example.

The light-shield layer 20A in the first example is also formed on the backsides of the bus electrodes Xb and Yb. In the PDP in the second example, however, a light-shield layer 30A extending in the row direction is formed on each portion between the bus electrodes Xb and Yb on the backside of the front glass substrate 10, while a light-shield layer 30A' extending in the row direction is formed in a position opposing each connection of the bus electrodes Xb, Yb of the transparent electrodes Xa, Ya. Further, a light-shield layer 30B extending in the column direction is formed in each position corresponding to the vertical walls 15*a* of the partition wall 15.

The remaining configuration is the same as that of the PDP in the first example and the same reference numerals are used.

Since the black conductive layers Xb', Yb' respectively forming the parts of the bus electrodes Xb, Yb on the display surface side have the function of preventing the ambient-light reflection in the first example, the PDP in the second example omits a light-shield layer formed on the portions of the backsides of the bus electrodes Xb and Yb. However, as in the first example, the reflection of ambient light from each non-display line is prevented.

Next, a method of manufacturing the above-mentioned PDP will be described.

FIGS. 8A to 8E illustrate steps for fabricating the aforementioned light-shield layer 20A of the first example, in the process of manufacturing the PDP.

Figure 8A:
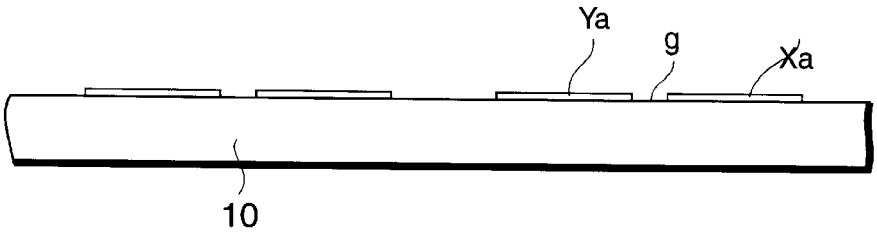
FIGS. 8A to 8E are explanatory drawings showing manufacturing steps of a plasma display panel according to the present invention.

First, transparent electrodes Xa and Ya are formed on the backside of the front glass substrate 10 with facing each other (FIG. 8A). Then, a paste made by mixing a black pigment and silver with a photosensitive binder is uniformly coated and dried by a screen printing technique to form a black photosensitive film. Then, a paste made by mixing silver with a photosensitive binder is uniformly coated and dried on the resulting black photosensitive layer by a screen printing technique to form a conductive layer.

Figure 8B:
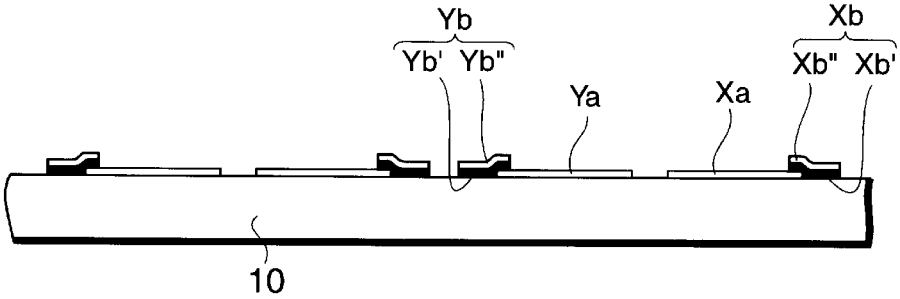

Then, the conductive layers are superimposed on the transparent electrodes Xa, Ya at opposite ends of the discharge gap by the patterning in the photolithographic process, to form band-shaped bus electrodes Xb, Yb respectively constructed of the black conductive layer Xb', Yb' and the main conductive layer Xb", Yb" (FIG. 8B).

Figure 8C:
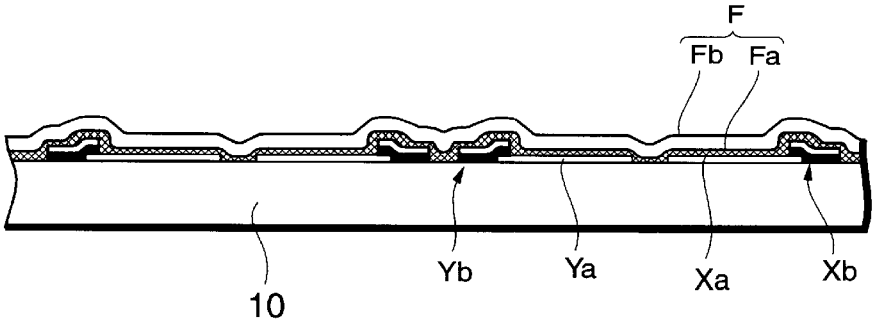

Then, as illustrated in FIG. 8C, a double-layer film F consisting of a black or dark-brown photosensitive resin layer Fa and a non-photosensitive resin layer Fb is laminated on the front glass substrate 10 with the black or dark-brown photosensitive resin layer Fa facing thereto.

The non-photosensitive resin layer Fb is formed of a resin to be dissolved by a developer for the photosensitive resin layer Fa as will be explained later.

In this event, a thickness of the photosensitive resin layer Fa is set to be equal to or smaller than a thickness of the bus electrode Xb, Yb formed by a thick-film technique. The total film thickness of the double-layer film F consisting of the photosensitive resin layer Fa and the non-photosensitive resin layer Fb is set to be sufficiently larger than that of the bus electrode Xb, Yb.

Upon lamination of the film F onto the backside of the front glass substrate 10 having bumps due to the bus electrodes Xb, Yb and the like, if the thickness of the film F is equal to or smaller than that of the bump caused by the bus electrode Xb, Yb, a problem in which air is caught up in the bump area occurs. However, since the non-photosensitive resin layer Fb serving as a dummy layer as described above makes the total film thickness of film F sufficiently larger than the film thickness of the bus electrode Xb, Yb, catching up air in the bump area is prevented.

Figure 8D:
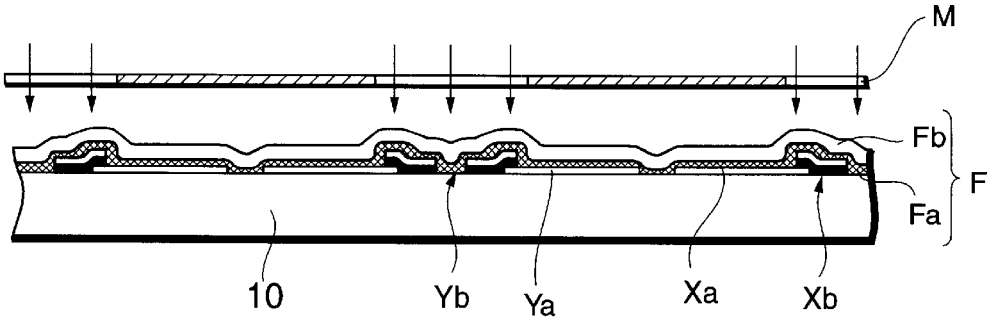

Next, as shown in FIG. 8D, the film F laminated on the backside of the front glass substrate 10 undergoes the photolithographic process to form patterns by exposing it to light through an exposure mask M for developing.

Figure 8E:
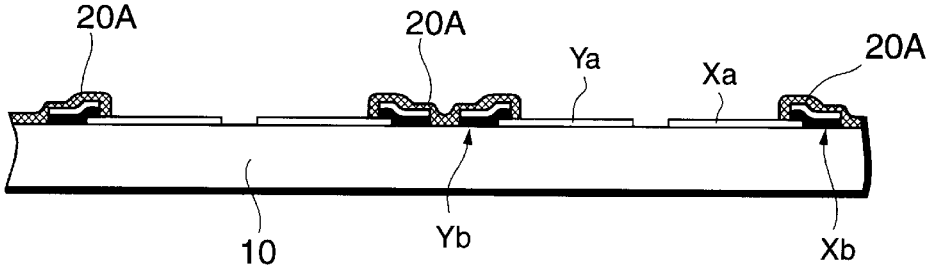

In this manner, as illustrated in FIG. 8E, a light-shield layer 20A is formed to overlay the area between the bus electrodes Xb and Yb which will serve as anon-display line, the backsides of the bus electrodes Xb and Yb, and the proximal end portions of the transparent electrodes Xa and Ya.

During the developing step, the non-photosensitive resin layer Fb of the film F is removed and also the not-exposed portions of the photosensitive resin layer Fa are removed.

As described above, the light-shield layer 20A having a thickness smaller than that of the bus electrode Xb, Yb is efficiently formed.

Similarly, the light-shield layer 20B in the first example and the light-shield layers 30A, 30A' and 30B in the second example are formed.

Figure 9:
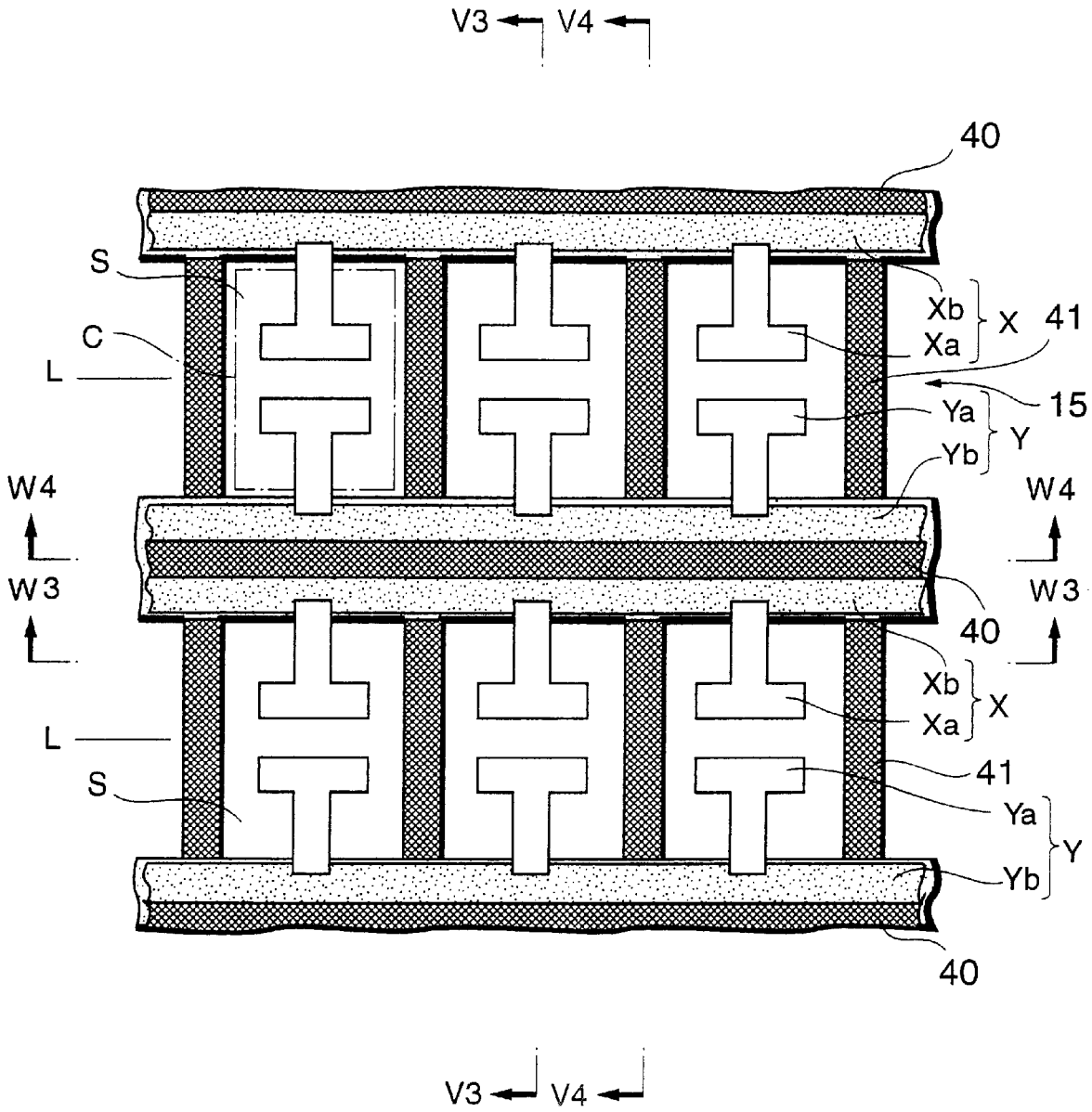
FIG. 9 is a front view schematically showing a third example according to the present invention.
Figure 10:
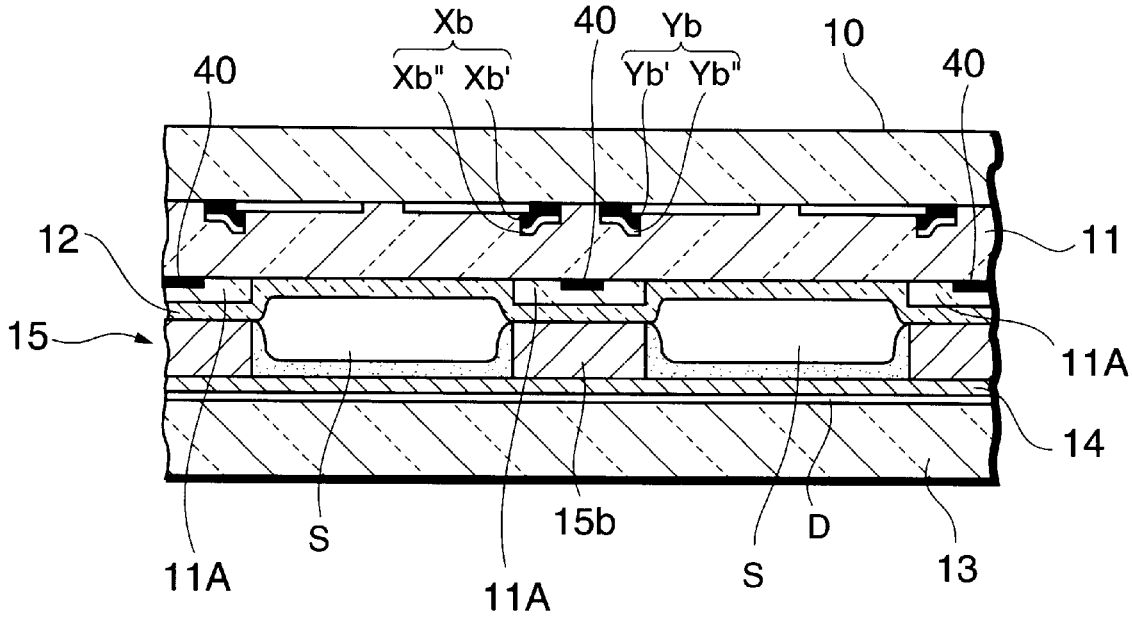
FIG. 10 is a sectional view taken along the V3—V3 line of FIG. 9.
Figure 11:
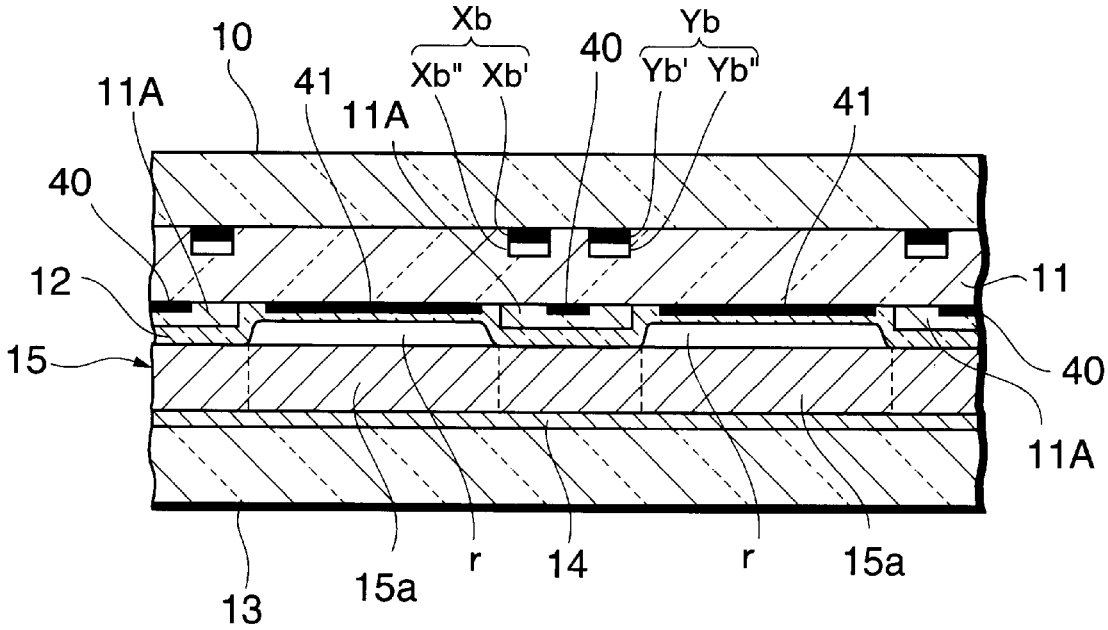
FIG. 11 is a sectional view taken along the V4—V4 line of FIG. 9.
Figure 12:
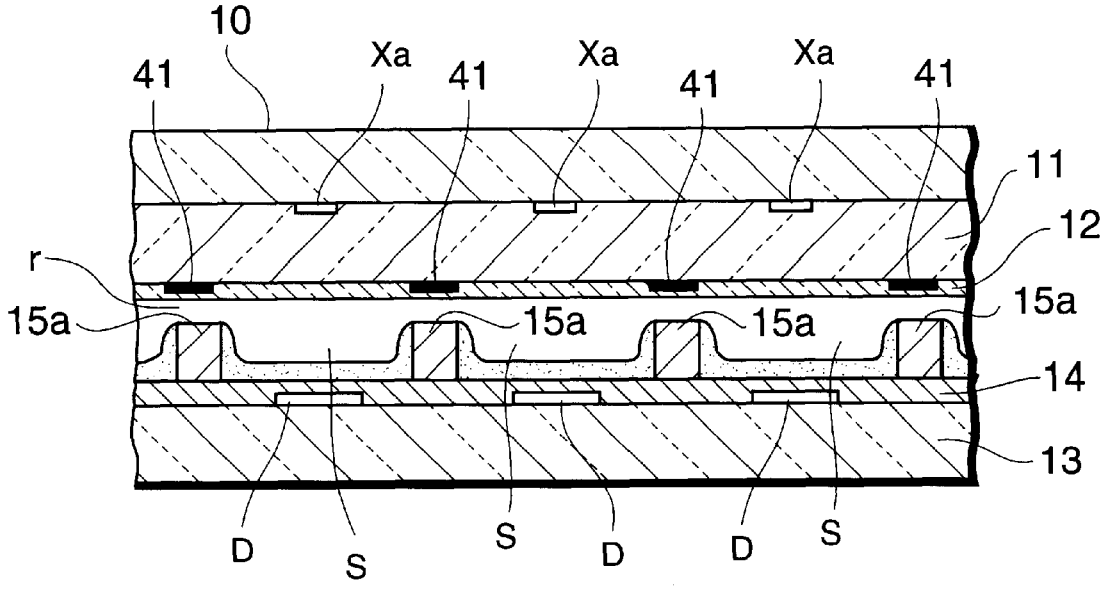
FIG. 12 is a sectional view taken along the W3—W3 line of FIG. 9.
Figure 13:
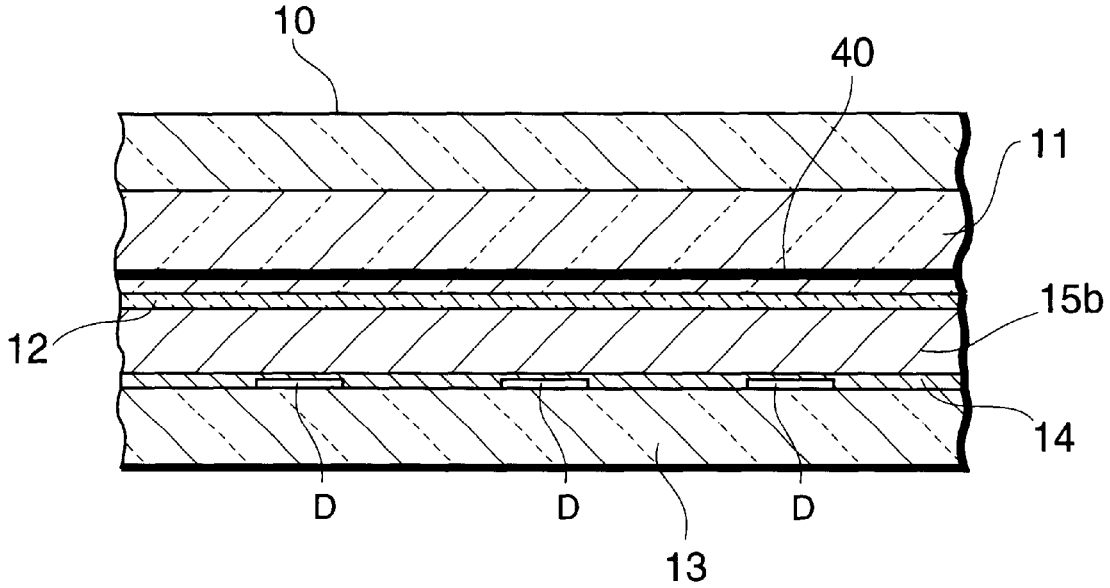
FIG. 13 is a sectional view taken along the W4—W4 line of FIG. 9.

Next, FIGS. 9 to 13 illustrate a third example of the embodiment of a plasma display panel (referred as "PDP" hereinafter) according to the present invention. FIG. 9 is a front view schematically illustrating a configuration of the PDP. FIG. 10 is a sectional view taken along the V3—V3 line of FIG. 9. FIG. 11 is a sectional view taken along the V4—V4 line of FIG. 9. FIG. 12 is a sectional view taken along the W3—W3 line of FIG. 9. FIG. 13 is a sectional view taken along the W4—W4 line of FIG. 9.

In the PDP of the third example, a black or dark-color light-shield layer 40 is formed in a band-like shape, extending in the row direction, on a portion of a joint face of a dielectric layer 11 with an additional dielectric layer 11A corresponding to an area between bus electrodes Xb and Yb arranged back to back. Further, a black or dark-color light-shield layer 41 is formed in a band-like shape, extending in the column direction, on a portion of the backside of the dielectric layer 11 corresponding to a vertical wall 15*a* of a partition wall 15 as in the light-shield layer 40.

The additional dielectric layer 11A and a protective layer 12 are formed after formation of the light-shield layers 40 and 41.

The configuration on other parts is the same as that of the foregoing PDP in the first example, and the same reference numbers are used.

In the PDP of the third example, the light-shield layer 40 absorbs ambient light incident upon the area between the bus electrodes Xb and Yb serving as a non-display line on the screen, while the light-shield layer 41 absorbs ambient light incident upon a face of the vertical wall 15*a* of the partition wall 15 on the display surface side, resulting in preventing the reflection of the ambient light incident on such area and face.

Next, a method of manufacturing the above PDP will be explained.

FIGS. 14A to 14E show steps of fabricating the light-shield layers 40 and 41 in the manufacturing process of the PDP.

For manufacturing the PDP, first, a transparent conductive film of $SnO_2$, ITO or the like is formed on the backside of the front glass substrate 10 by a vacuum deposition technique or the like.

Then, the transparent conductive film is patterned in a T-like shape by the photolithographic process to form pairs of transparent electrodes independent of one another for each discharge cell (not shown).

Figure 14A:
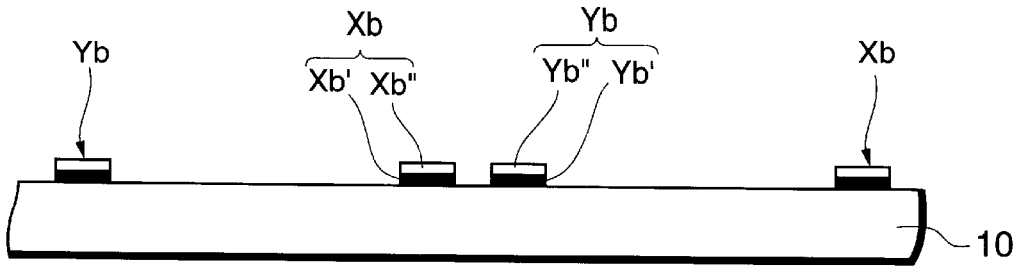
FIGS. 14A to 14E are explanatory drawings showing manufacturing steps of a plasma display panel in the third example according to the present invention.

After that, as shown in FIG. 14A, on the front glass substrate 10 on which a pair of the transparent electrodes is formed, a paste made by mixing a black pigment and silver with a photosensitive binder is uniformly coated and dried by a screen printing technique to form a photosensitive type black conductive layer Xb' and Yb'.

Then, on the front glass substrate 10 on which the black conductive layers Xb' and Yb' are formed, a paste made by mixing silver with a photosensitive binder is uniformly coated and dried by a screen printing technique to form a conductive film. Then, this front glass substrate 10 undergoes the photolithographic process to pattern main conductive layers Xb" and Yb". The black conductive layers Xb', Yb' and the main conductive layers Xb", Yb" respectively form bus electrodes Xb and Yb. Each of the bus electrodes Xb, Yb extends in the row direction and is superimposed on proximal ends of the transparent electrodes.

Figure 14B:
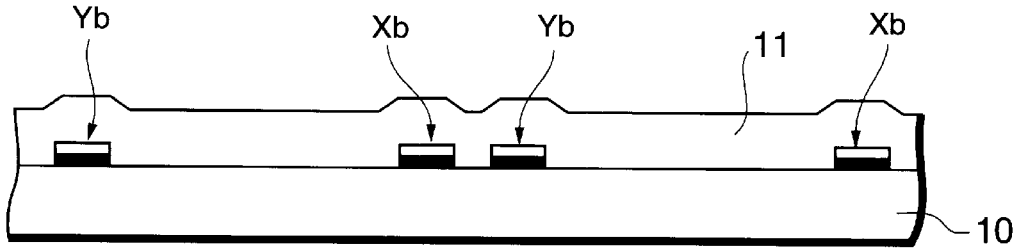

Then, as shown in FIG. 14B, on the front glass substrate 10 on which the transparent electrodes and the bus electrodes Xb and Yb are formed, a low-melting glass paste is uniformly coated and burned to form a dielectric layer 11.

The dielectric layer 11 may be formed by laminating a film-shaped low-melting glass paste on the front glass substrate 10 and burning it.

Figure 14C:
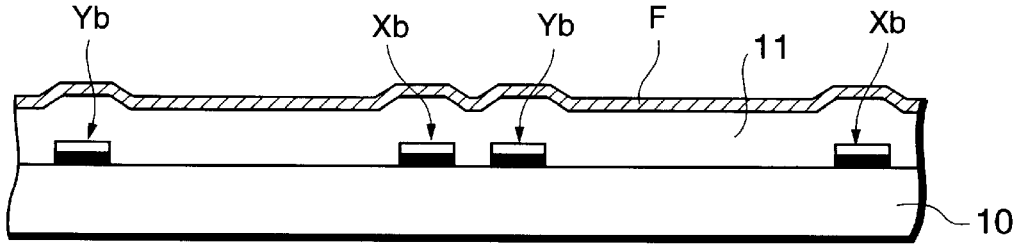

Then, as illustrated in FIG. 14C, a single-layer film F consisting of a black or dark-color photosensitive resin layer is laminated on the dielectric layer 11.

In this event, comparing with the case where the film F is laminated directly on the front glass substrate 10 on which the bus electrodes Xb and Yb or the like form the dumps, the film F is laminated on the dielectric layer 11 with smaller dumps caused by the bus electrodes Xb and Yb or the like. Accordingly, the problem in which air is caught up in the dump area may not occur.

Figure 14D:
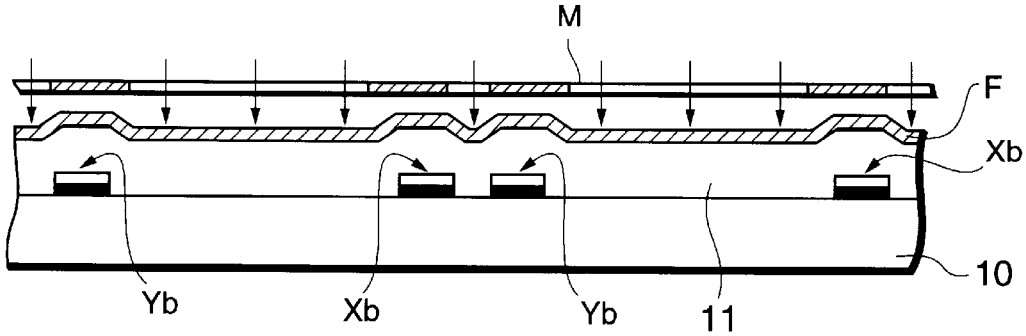

Then, as shown in FIG. 14D, the film F laminated on the dielectric layer 11 undergoes the patterning through the photolithographic process in which it is exposed to light through an exposure mask M for developing.

Figure 14E:
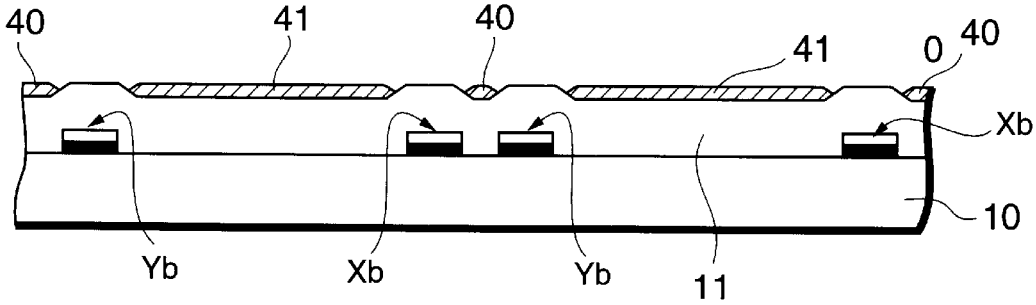

As illustrated in FIG. 14E, thus, the light-shield layer 40 is formed on a portion on the dielectric layer 11 corresponding to an area between the bus electrodes Xb and Yb arranged back to back (between the row electrode pairs which will serve as a non-display line). Further, the light-shield layer 41 is formed on a portion of the dielectric layer 11 in correspondence with the vertical wall 15*a* of the partition wall 15 (see FIGS. 11 and 12).

In this event, portions of the film F which are not exposed to light are removed during the developing step.

After formation of the light-shield layers 40 and 41, an additional dielectric layer is formed on the portions of the dielectric layer 11 corresponding to the positions where the bus electrode layers Xb, Yb and the light-shield layer 40 are formed, by the screen printing technique or the like. Then, a protective layer of MgO is formed to overlay the additional dielectric layer and the dielectric layer.

With the above steps, the light-shield layers 40 and 41 are formed efficiently using the film F.

In the above PDP of the third example, the light-shield layers 40 and 41 absorb ambient light, incident from the front glass substrate 10 directed toward the area between the bus electrodes Xb and Yb serving as a non-display line and toward the area corresponding to the vertical wall 15*a* of the partition wall 15 on which a phosphor layer is not formed, these areas not contributing to the formation of images. Thus, the reflection of the ambient light incident upon such areas is prevented.

Next, a fourth example of the embodiment according to the present invention will be explained.

Figure 15:
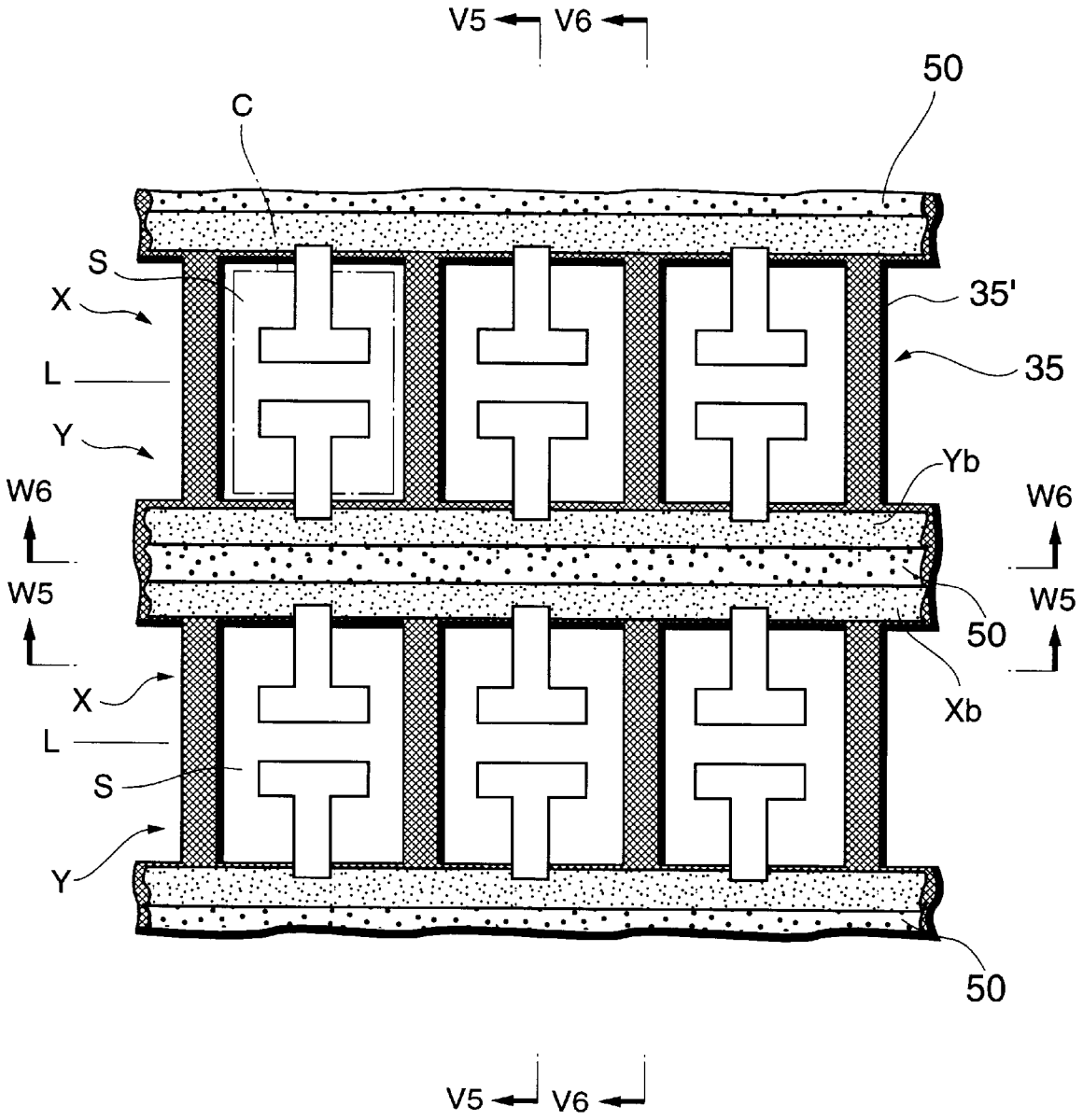
FIG. 15 is a front view schematically showing a fourth example according to the present invention.
Figure 16:
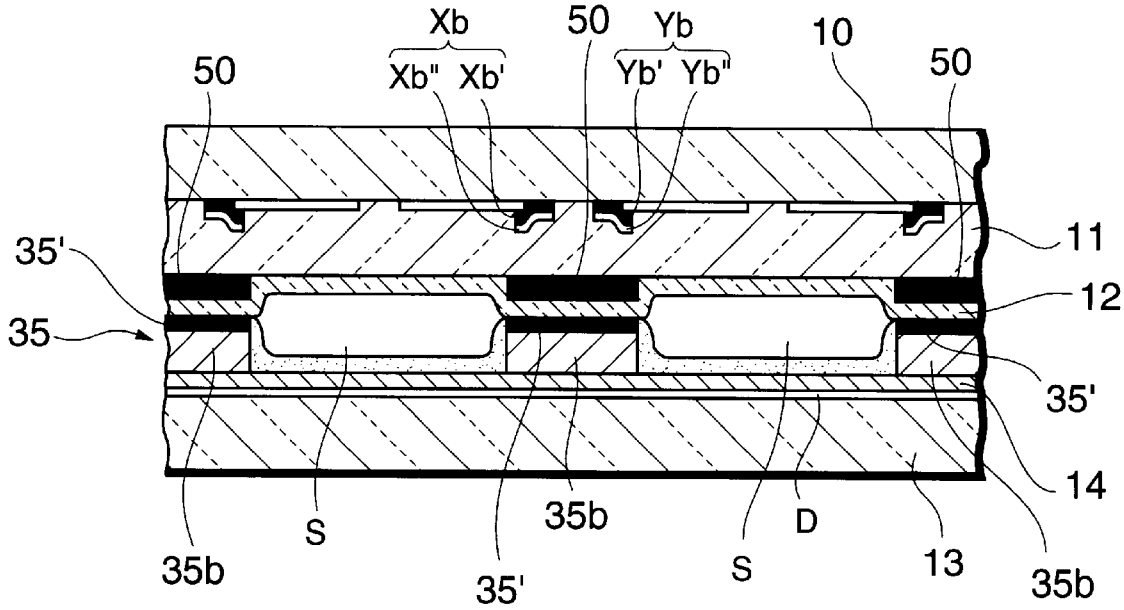
FIG. 16 is a sectional view taken along the V5—V5 line of FIG. 15.
Figure 17:
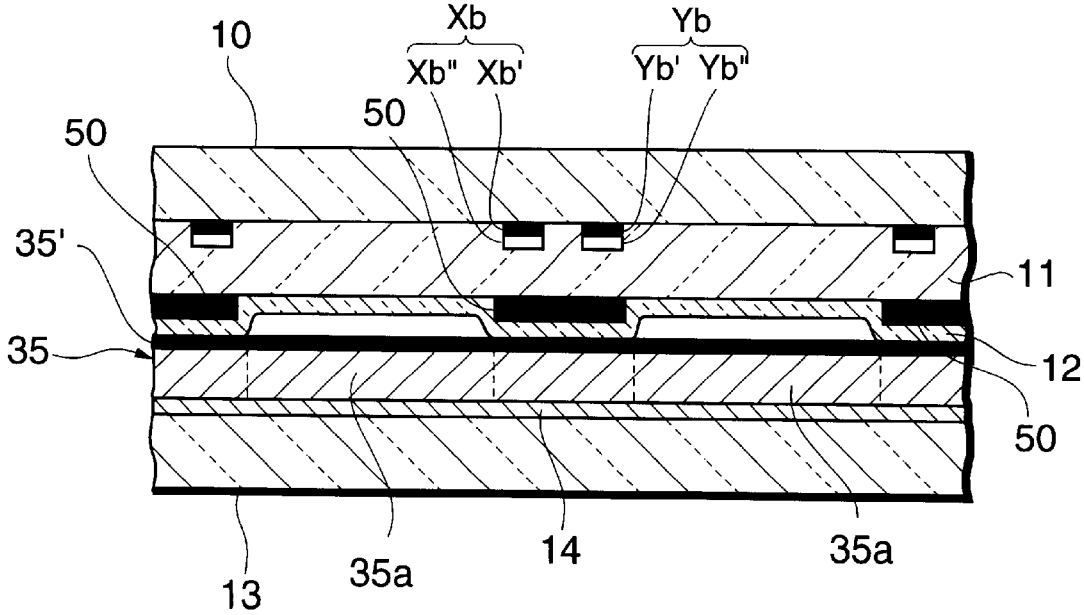
FIG. 17 is a sectional view taken along the V6—V6 line of FIG. 15.
Figure 18:
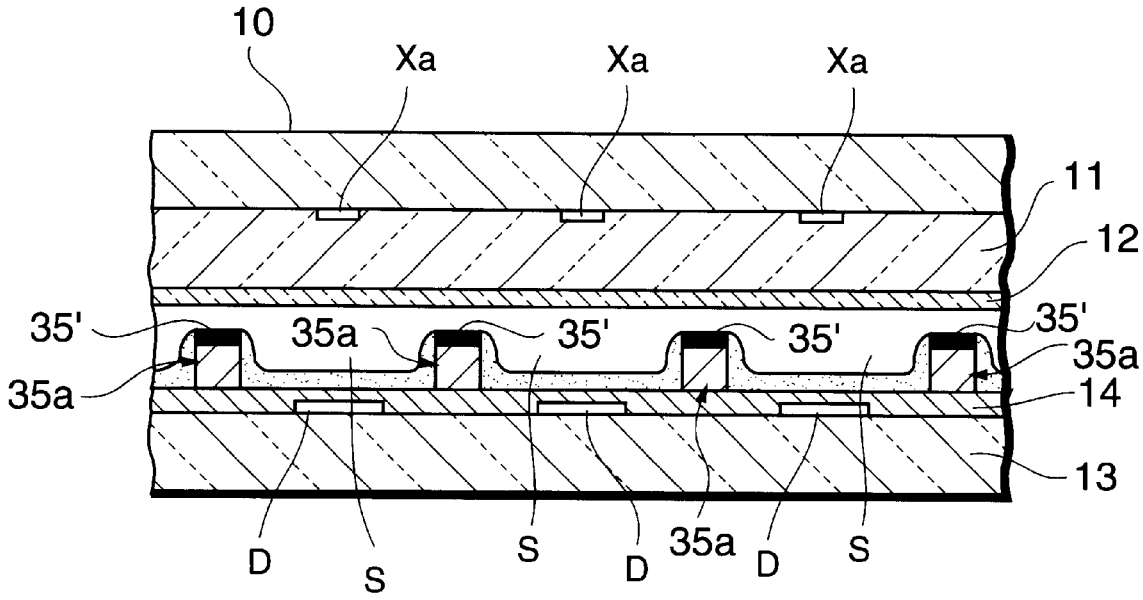
FIG. 18 is a sectional view taken along the W5—W5 line of FIG. 15.
Figure 19:
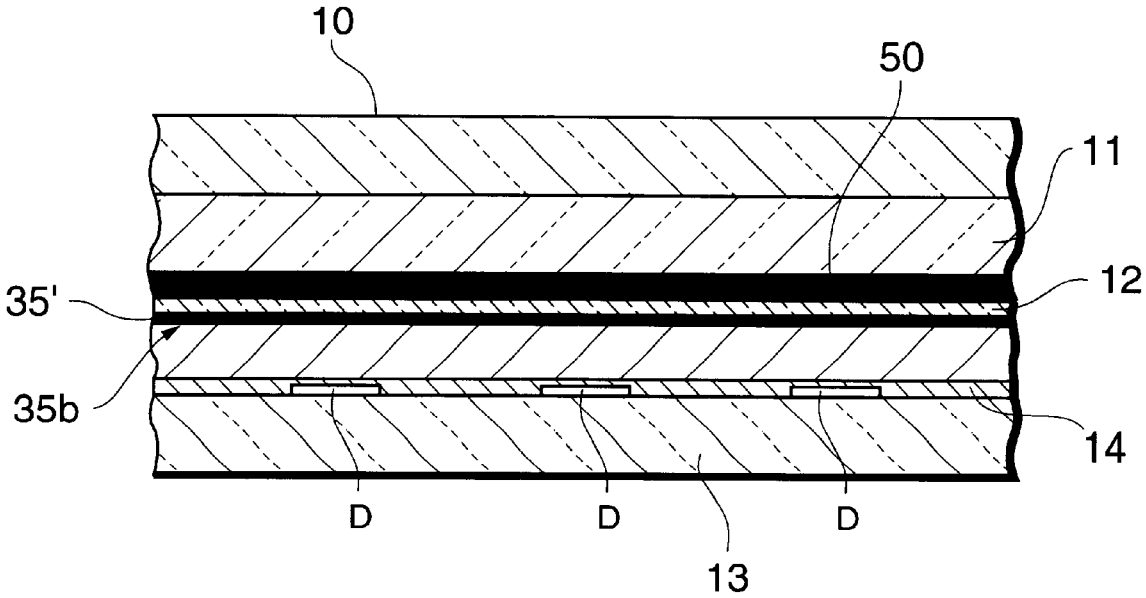
FIG. 19 is a sectional view taken along the W6—W6 line of FIG. 15.

FIGS. 15 to 19 shows the fourth example of the embodiment of the PDP according to the present invention. FIG. 15 is a front view schematically illustrating a configuration of the PDP. FIG. 16 is a sectional view taken along the V5—V5 line of FIG. 15. FIG. 17 is a sectional view taken along the V6—V6 line of FIG. 15. FIG. 18 is a sectional view taken along the W5—W5 line of FIG. 15. FIG. 19 is a sectional view taken along the W6—W6 line of FIG. 15.

In FIGS. 15 to 19, the same reference numerals are used for the parts of the same configurations as those of the PDP of the third example.

In the PDP of the fourth example, an additional dielectric layer 50 consists of a black or dark color light-shield layer and is formed in such a way as to protrude toward the discharge space S from a portion of the backside of a dielectric layer 11 corresponding to the back-to-back bus electrodes Xb and Yb, area between the back-to-back bus electrodes Xb and Yb, and portions of the proximal ends of the transparent electrodes Xa and Ya respectively connected to these bus electrodes Xb and Yb.

Further, a black or dark color light-shield layer 35' forms faces of a vertical wall 35*a* and a transverse wall 35*b* of a square-like patterned partition wall 35 arranged in the discharge space S between the front glass substrate 10 and the back glass substrate 13, the faces orienting toward the front glass substrate 10.

In the PDP, the additional dielectric layer 50 absorbs ambient light incident upon the area between the bus electrodes Xb and Yb serving as a non-display line on the screen. Further, the light-shield layer 35' of the partition wall 35 absorbs ambient light incident upon the face of the vertical wall 35*a* of the partition wall 35 on the display surface side. Thus, the reflection of the ambient light incident upon such area and face is prevented.

Next, a method of manufacturing the PDP of the fourth example will be explained.

FIGS. 20A to 20E show steps of fabricating the additional dielectric layer 50 in the manufacturing process of the PDP.

For manufacturing the PDP, first, a transparent conductive film of $SnO_2$, ITO or the like is formed on the backside of the front glass substrate 10 by a vacuum deposition technique or the like. Then, the transparent conductive film is patterned in a T-like shape by the photolithographic process to form pairs of transparent electrodes independent of one another for each discharge cell (not shown).

Figure 20A:
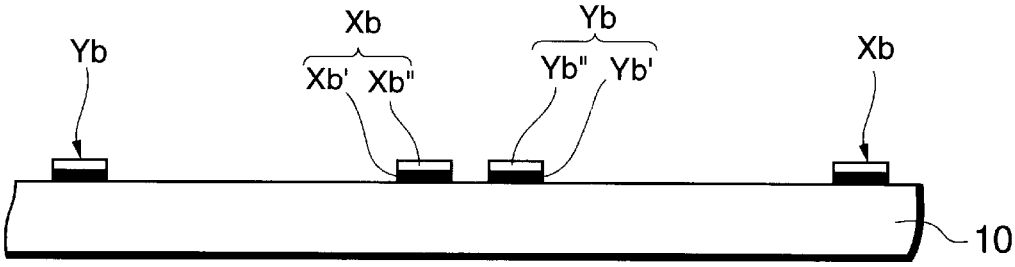
FIGS. 20A to 20E are explanatory drawings showing manufacturing steps of a plasma display panel in the fourth example according to the present invention.

After that, as shown in FIG. 20A, on the front glass substrate 10 on which pairs of the transparent electrodes are formed, a paste made by mixing a black pigment and silver with a photosensitive binder is uniformly coated and dried by a screen printing technique to form a photosensitive type black conductive layers Xb' and Yb'.

Then, on the front glass substrate 10 on which the black conductive layers Xb' and Yb' are formed, a paste made by mixing silver with a photosensitive binder is uniformly coated and dried by a screen printing technique to form a conductive film. Then, this front glass substrate 10 undergoes the photolithographic process to pattern main conductive layers Xb" and Yb". The black conductive layers Xb', Yb' and the main conductive layers Xb", Yb" respectively form bus electrodes Xb and Yb. Each of the bus electrodes Xb, Yb extends in the row direction and is superimposed on proximal ends of the transparent electrodes.

Figure 20B:
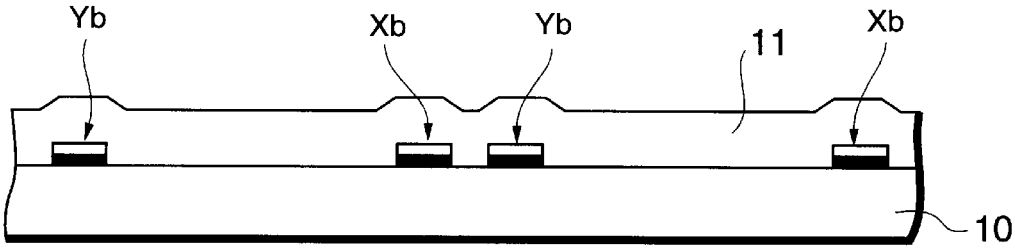

Then, as shown in FIG. 20B, on the front glass substrate 10 on which the transparent electrodes and the bus electrodes Xb and Yb are formed, a low-melting glass paste is uniformly coated and burned to form a dielectric layer 11.

The dielectric layer 11 may be formed by laminating a film-shaped low-melting glass paste on the front glass substrate 10 and burning it.

Figure 20C:
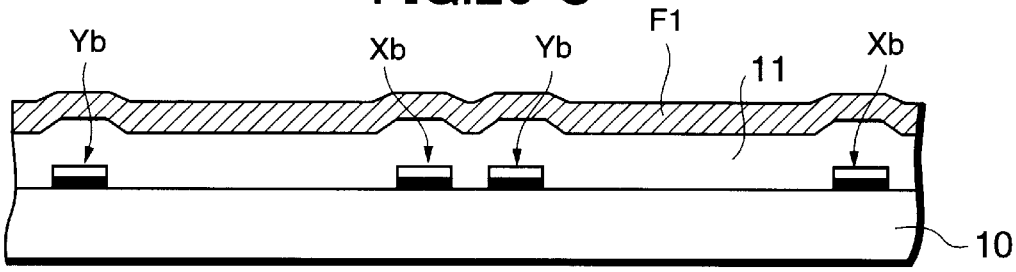

Then, as illustrated in FIG. 20C, a single-layer dielectric film F1 consisting of a black or dark-color photosensitive resin layer having a thickness in range of approximately 20–30 microns is laminated on the dielectric layer 11.

The dielectric film F1 is a film-shaped paste made by mixing powders of black or dark color pigment and low-melting glass with a photosensitive binder.

Figure 20D:
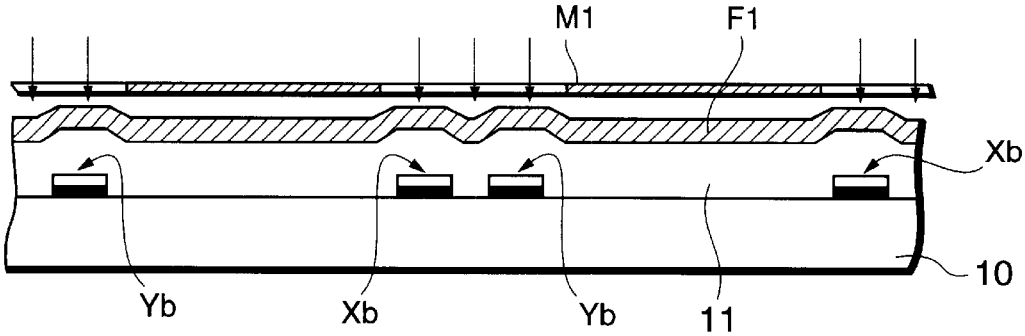

Then, as shown in FIG. 20D, the laminated dielectric film F1 undergoes the photolithographic process to expose it to light through an exposure mask M1 for developing to form patterns.

Figure 20E:
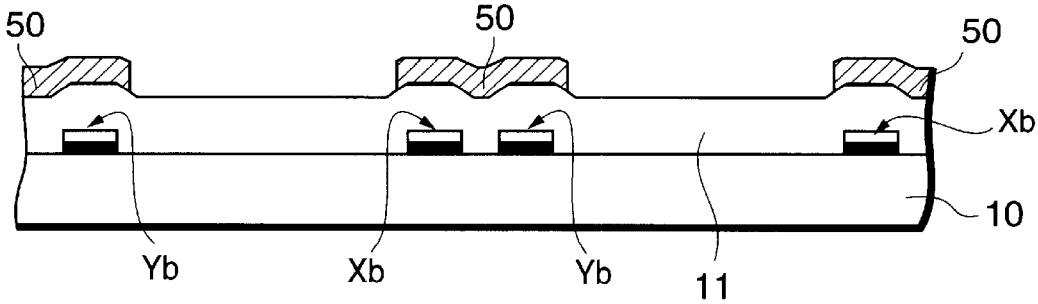

As illustrated in FIG. 20E, thus, the additional dielectric layer 50 is formed on the portion of the backside of the dielectric layer 11 opposing the bus electrodes Xb and Yb, the area between the bus electrodes Xb, Yb (between the row electrode pairs which will serve as each non-display line), and the proximal end portions of the transparent electrodes respectively connected to the bus electrodes Xb, Yb.

With the above steps, the additional dielectric layer 50 also functions as a light-shield layer and is efficiently formed by using the dielectric film F1.

Next, a fifth example of the embodiment according to the present invention will be described.

Figure 21:
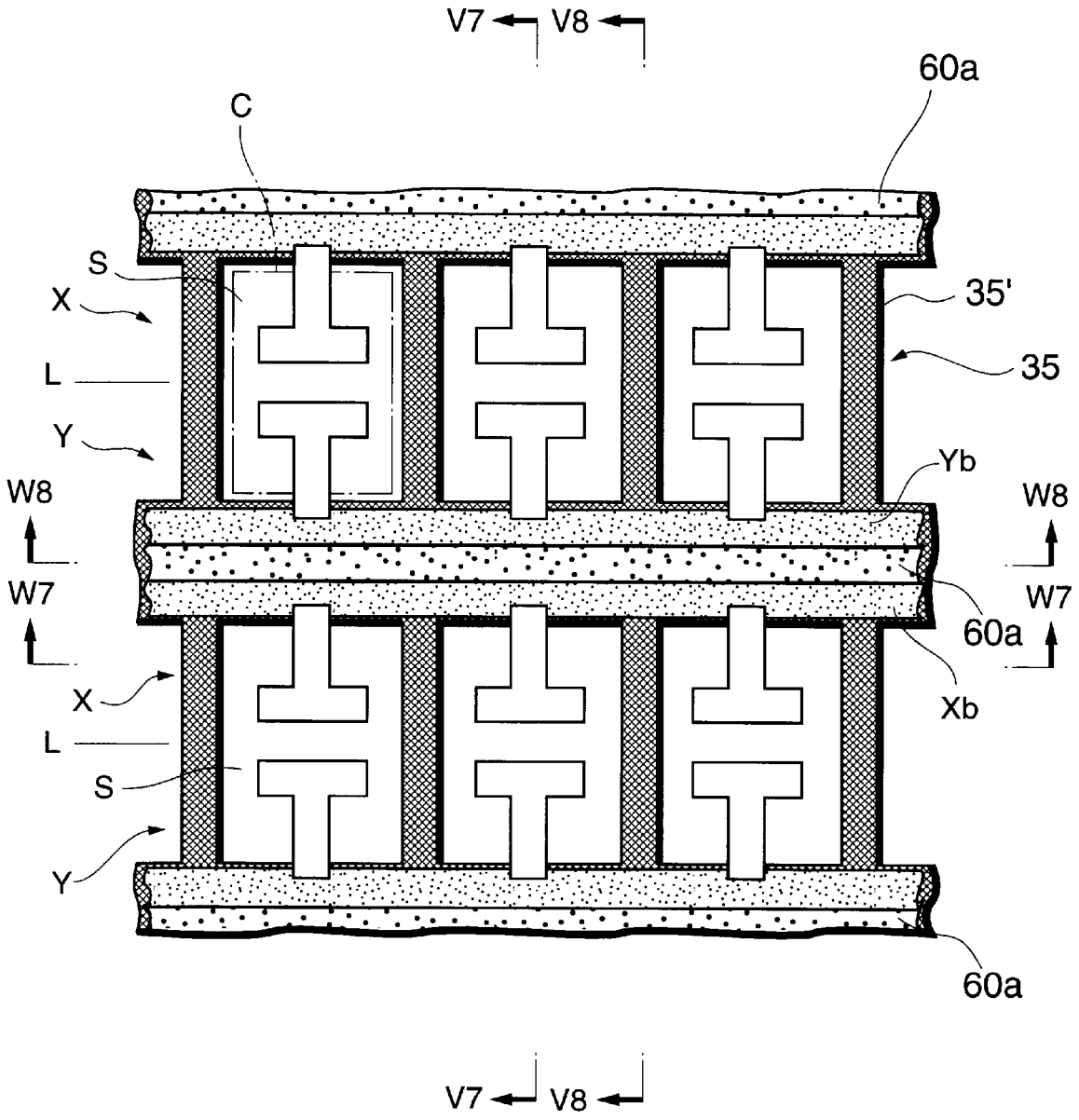
FIG. 21 is a front view schematically showing a fifth example according to the present invention.
Figure 22:
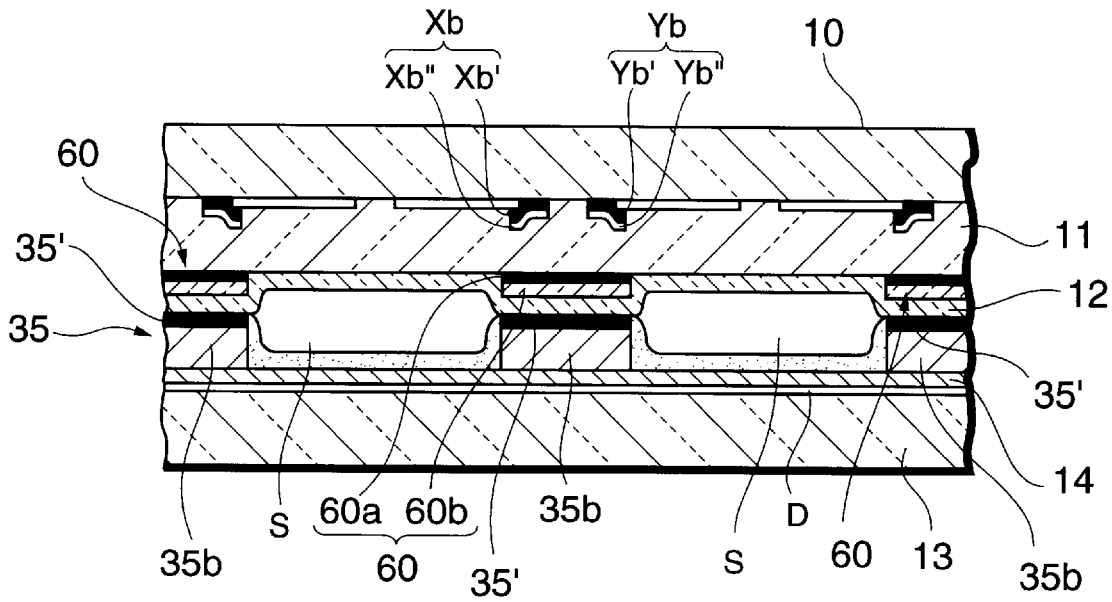
FIG. 22 is a sectional view taken along the V7—V7 line of FIG. 21.
Figure 23:
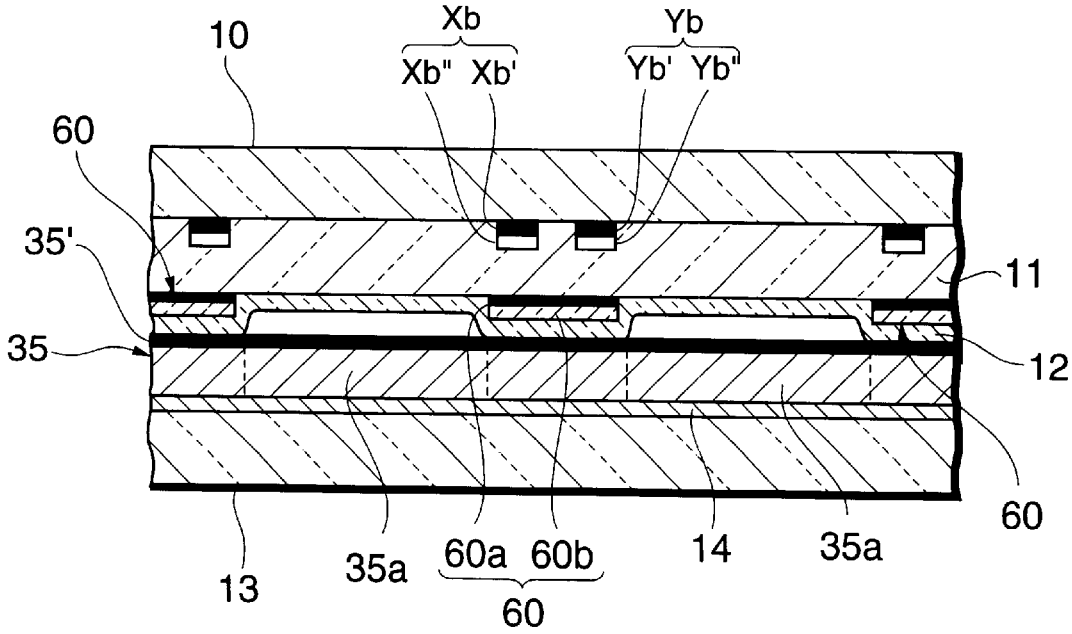
FIG. 23 is a sectional view taken along the V8—V8 line of FIG. 21.
Figure 24:
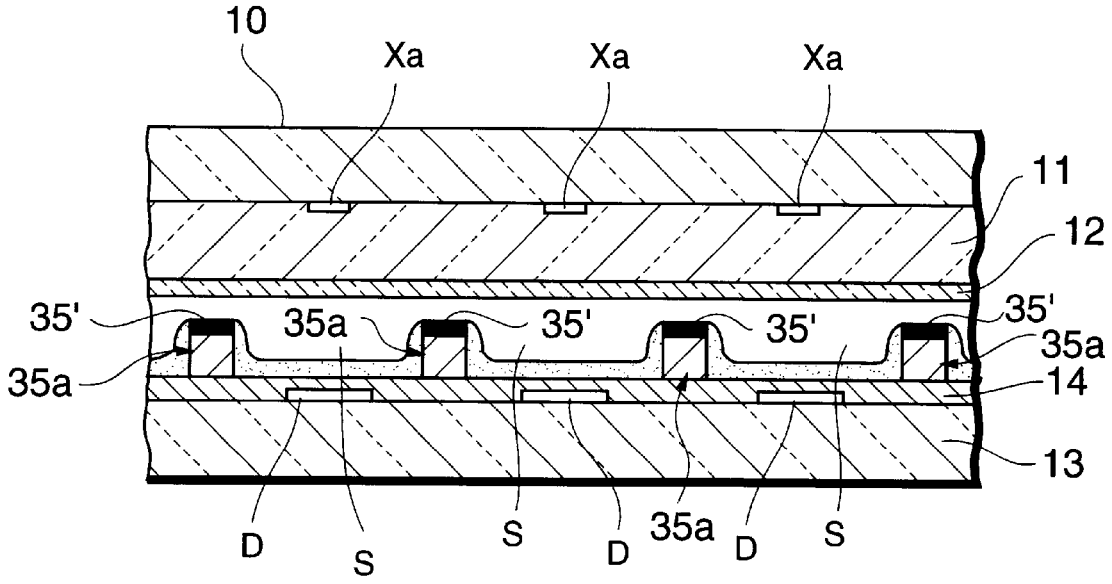
FIG. 24 is a sectional view taken along the W7—W7 line of FIG. 21.
Figure 25:
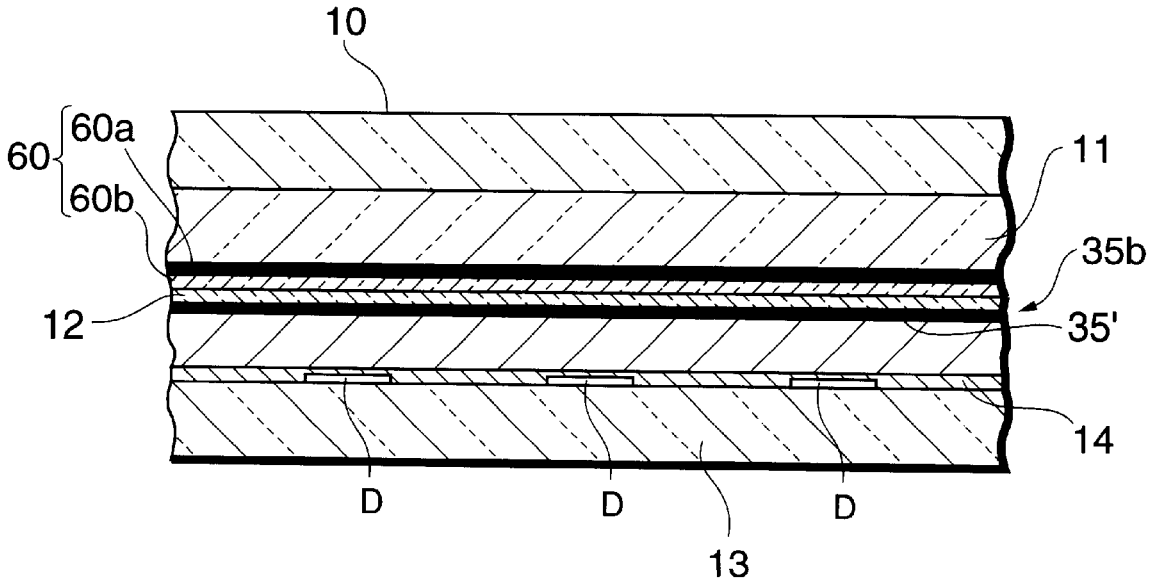
FIG. 25 is a sectional view taken along the W8—W8 line of FIG. 21.

FIGS. 21 to 25 show the fifth example of the embodiment of the PDP according to the present invention. FIG. 21 is a front view schematically illustrating a configuration of the PDP. FIG. 22 is a sectional view taken along the V7—V7 line of FIG. 21. FIG. 23 is a sectional view taken along the V8—V8 line of FIG. 21. FIG. 24 is a sectional view taken along the W7—W7 line of FIG. 21. FIG. 25 is a sectional view taken along the W8—W8 line of FIG. 21.

In FIGS. 21 to 25, the same reference numerals are used for the configurations of the same parts as those of the PDP of the fourth example.

The additional dielectric layer 50 of the PDP in the fourth example is formed of the black or dark color light-shield layer. For the PDP in the fifth example, however, a portion of an additional dielectric layer 60 joined to a dielectric layer 11 consists of a black or dark color photosensitive dielectric layer 60*a*, while a portion of the additional dielectric layer 60 protruding toward the back glass substrate 13 consists of a transparent photosensitive dielectric layer 60*b*.

Faces of a vertical wall 35*a* and a transverse wall 35*b* of a partition wall 35 on the front glass substrate 10 side consist of a black or dark color light-shield layer 35' as in the fourth example.

In the PDP, the photosensitive dielectric layer 60*a* of the additional dielectric layer 60 absorbs ambient light incident upon the area between the bus electrodes Xb and Yb as a non-display line on the screen. Further, the light-shield layer 35' of the partition wall 35 absorbs ambient light incident upon the face of the vertical wall 35*a* of the partition wall 35 on the display surface side. Thus, the reflection of ambient light incident upon such area and face is prevented.

Next, a method of manufacturing the PDP will be explained.

FIGS. 26A to 26E show steps of fabricating the additional dielectric layer 60 in the manufacturing process of the PDP of the fifth example.

For manufacturing the PDP, first, a transparent conductive film of $SnO_2$, ITO or the like is formed on the backside of the front glass substrate 10 by a vacuum deposition technique or the like. Then, the transparent conductive film is patterned in a T-like shape by the photolithographic process to form pairs of transparent electrodes independent of one another for each discharge cell (not shown).

Figure 26A:
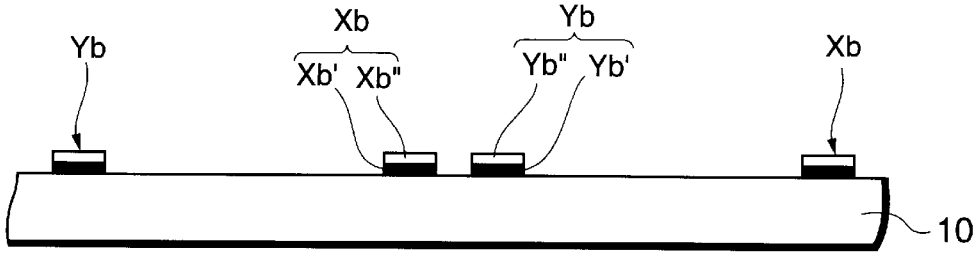
FIGS. 26A to 26E are explanatory drawings showing manufacturing steps of a plasma display panel in the fifth example according to the present invention.

After that, as shown in FIG. 26A, on the front glass substrate 10 on which pairs of the transparent electrodes are formed, a paste made by mixing a black pigment and silver with a photosensitive binder is uniformly coated and dried by a screen printing technique to form photosensitive type black conductive layers Xb' and Yb'.

Then, on the front glass substrate 10 on which the black conductive layers Xb' and Yb' are formed, a paste made by mixing silver with a photosensitive binder is uniformly coated and dried by a screen printing technique to form a conductive film. Then, this front glass substrate 10 undergoes the photolithographic process to pattern main conductive layers Xb" and Yb". The black conductive layers Xb', Yb' and the main conductive layers Xb", Yb" respectively form bus electrodes Xb and Yb. Each of the bus electrodes Xb, Yb extends in the row direction and is superimposed on proximal ends of the corresponding transparent electrodes.

Figure 26B:
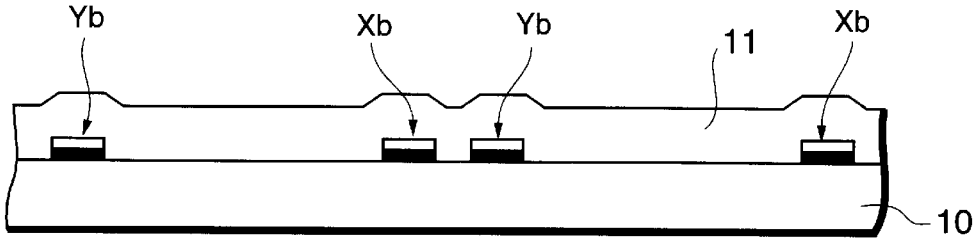

Then, as shown in FIG. 26B, on the front glass substrate 10 on which the transparent electrodes and the bus electrodes Xb and Yb are formed, a low-melting glass paste is uniformly coated and burned to form a dielectric layer 11.

The dielectric layer 11 may be formed by laminating a film-shaped low-melting glass paste on the front glass substrate 10 and burning it.

Figure 26C:
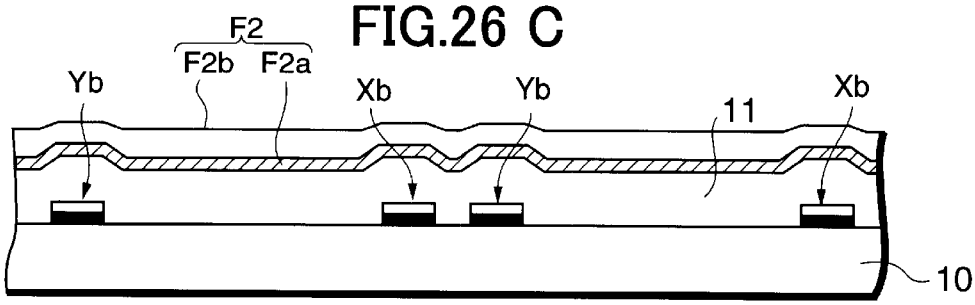

Then, as illustrated in FIG. 26C, a double-layer dielectric film F2 consisting of a black or dark-color photosensitive dielectric layer F2*a* having a thickness in range of approximately 20–30 microns and a transparent photosensitive dielectric layer F2*b* is laminated on the dielectric layer 11 with the photosensitive dielectric layer F2*a* facing the dielectric layer 11.

The photosensitive dielectric layer F2*a* is formed of a black or dark color pigment, low-melting glass powder and a photosensitive resin binder, while the photosensitive dielectric layer F2*b* is formed of low-melting glass powder and a photosensitive resin binder but not including a black or dark color pigment.

Figure 26D:
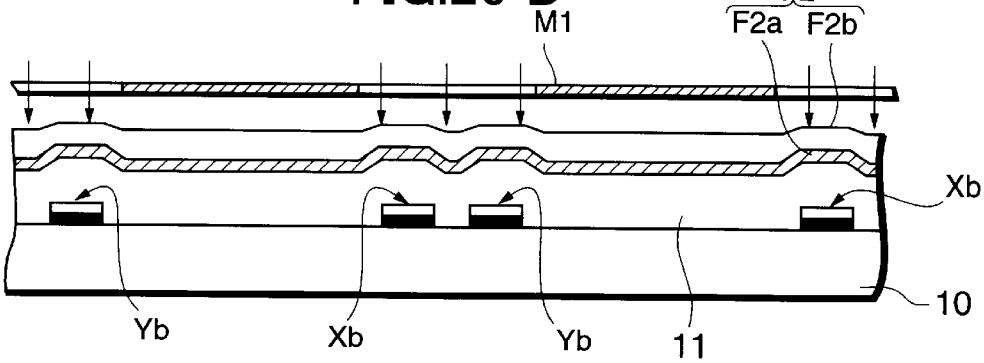

Then, as shown in FIG. 26D, the laminated dielectric film F2 undergoes the photolithographic process to expose it to light through an exposure mask M1 for developing to form patterns.

In this event, a decrease of photosensitive characteristics during the exposing is suppressed because the photosensitive dielectric layer F2*b* of the dielectric film F2 serving as an exposed surface is made of transparent materials.

Figure 26E:
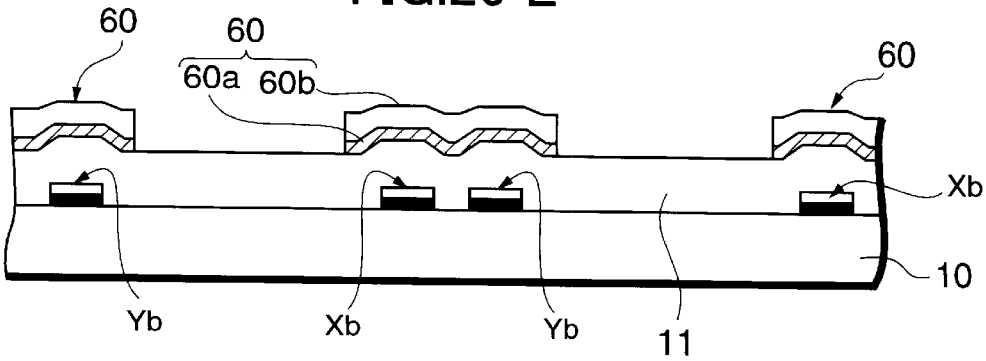
Figure 27:
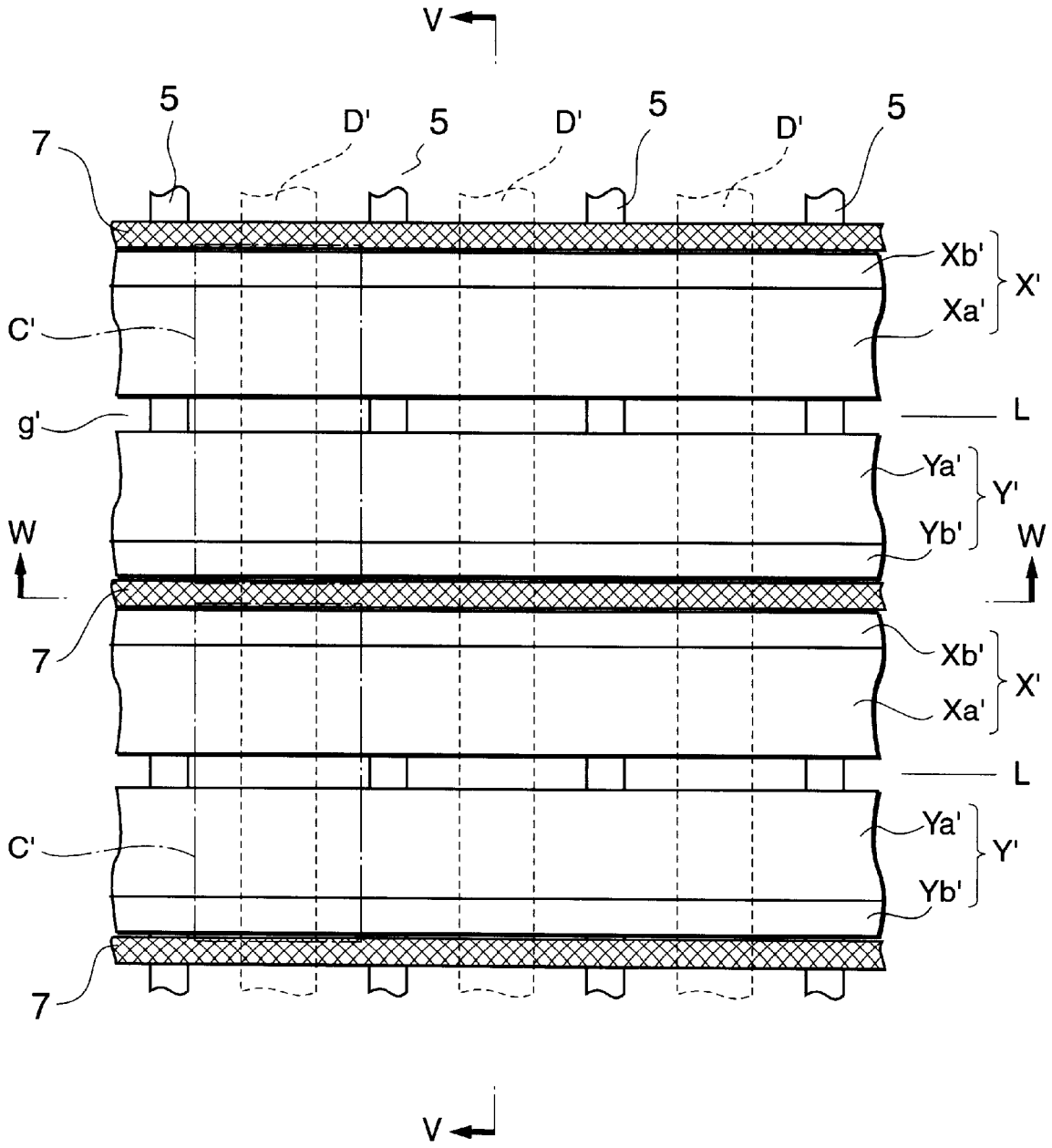
FIG.27 PRIOR ART
FIG. 27 is a front view showing the plasma display panel according to the prior suggestion.
Figure 28:
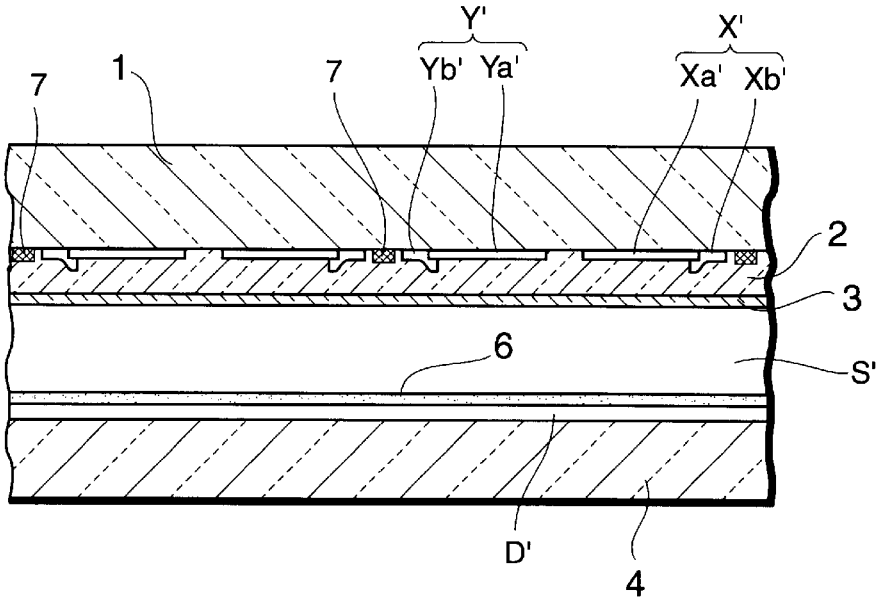
FIG.28 PRIOR ART
FIG. 28 is a sectional view taken along the V—V line of FIG. 27.
Figure 29:
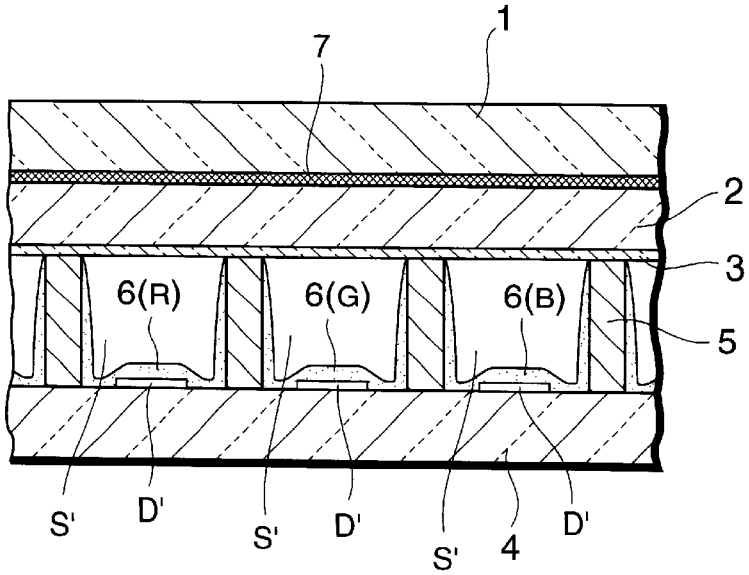
FIG.29 PRIOR ART
FIG. 29 is a sectional view taken along the W—W line of FIG. 27.

As illustrated in FIG. 26E, thus, the additional dielectric layer 60 of the double-layer structure made up of the photosensitive dielectric layer 60*a* and the photosensitive dielectric layer 60*b* is formed on a portion of the backside of the dielectric layer 11 opposing the bus electrodes Xb, Yb, the area between the bus electrodes Xb, Yb (between the row electrode pairs which will serve as a non-display line), and the proximal end portions of the transparent electrodes respectively connected to the bus electrodes Xb, Yb.

With the above steps, the additional dielectric layer 60 also functions as the light-shield layer and is efficiently formed by using the dielectric film F2.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a plurality of row electrode pairs extending in a row direction and arranged in a column direction to respectively form display lines on a backside of a front substrate, and a plurality of column electrodes extending in the column direction and arranged in the row direction to constitute unit light emitting areas in a discharge space at respective positions, corresponding to intersections of the column electrodes and the row electrode pairs, on a surface of a back substrate facing the front substrate with a discharge space in between, each row electrode of said row electrode pair being made up of transparent electrodes each formed opposite to the corresponding transparent electrode via a predetermined discharge gap, and a bus electrode extending in the row direction and connected to ends of the transparent electrodes situated opposite to the discharge gap, said plasma display panel comprising:

a light-shield layer formed at least on a portion of a backside of the front substrate between the two back-to-back bus electrodes of the adjacent row electrode pairs in the row direction and on the portions of the proximal ends of the transparent electrodes connected to sides of the bus electrodes.

2. The plasma display panel according to claim 1, further comprising:

a partition wall arranged between the front substrate and the back substrate and including vertical walls extending in the column direction and transverse walls extending in the row direction to define the discharge space into the unit light emitting areas in the row direction and the column direction, wherein said light-shield layer is formed at a position corresponding to a face of said transverse wall of the partition wall on the front substrate side when viewed from the front substrate.

3. The plasma display panel according to claim 1 wherein a portion of said bus electrode on the front substrate side consists of a light absorption layer.

4. The plasma display panel according to claim 1, wherein said light-shield layer is still formed on a portion of the backside of the front substrate opposing the vertical wall of the partition wall.

5. A plasma display panel including a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction to constitute unit light emitting areas in a discharge space at respective positions, corresponding to intersections of the column electrodes and the row electrode pairs, on a surface of a back substrate facing the front substrate with a discharge space in between, each row electrode of said row electrode pair being made up of transparent electrodes each formed to oppose the corresponding transparent electrode via a predetermined discharge gap, and a bus electrode extending in the row direction and connected to an end of the transparent electrode situated opposite to the discharge gap, said plasma display panel comprising:

a light-shield layer formed on a backside of said dielectric layer to overlay a portion situated between the row electrode pairs and surrounded by the respective bus electrodes when viewed from the front substrate.

6. The plasma display panel according to claim 5, further comprising:

a partition wall arranged between the front substrate and the back substrate and including vertical walls extending in the column direction and transverse walls extending in the row direction to define the discharge space into the unit light emitting areas in the row direction and the column direction, and another light-shield layer formed on said dielectric layer in alignment with said vertical wall of said partition wall when viewed from the front substrate.

7. A plasma display panel including a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction to constitute unit light emitting areas in a discharge space at respective positions, corresponding to intersections of the column electrodes and the row electrode pairs, on a surface of a back substrate facing the front substrate with a discharge space in between, each row electrode of said row electrode pair being made up of transparent electrodes formed to oppose the corresponding transparent electrode via a predetermined discharge gap, and a bus electrode extending in the row direction and connected an end of the transparent electrode situated opposite to the discharge gap, said plasma display panel comprising:

an additional portion formed on a backside of said dielectric layer to oppose the back-to-back arranged bus electrodes of the adjacent row electrode pairs in the column direction and a portion surrounded by the back-to-back bus electrodes and to protrude toward the discharge space, and a light-shield layer formed on at least a portion of a backside of the dielectric layer in which said additional portion is formed opposing the portion surrounded by said back-to-back bus electrodes.

8. The plasma display panel according to claim 7, wherein said additional portion is formed of a black or dark color photosensitive resin.

9. The plasma display panel according to claim 7, wherein a joint face of said additional portion to said dielectric layer consists of said light-shield layer.

10. The plasma display panel according to claim 7, further comprising:

a partition wall arranged between the front substrate and the back substrate and including vertical walls extending in the column direction and transverse walls extending in the row direction to define the discharge space into the unit light emitting areas in the row direction and the column direction, and another light-shield layer making up a face of said partition wall on the front substrate side.

* * * * *